US005959223A

United States Patent [19]

Kitashima et al.

[11] Patent Number: 5,959,223

[45] Date of Patent: Sep. 28, 1999

[54] METHOD OF ASSEMBLING AN UPRIGHT PIANO

[75] Inventors: Riichi Kitashima; Makoto Kanemitsu; Shinichiro Miwa; Hidetaka Hanajima, all of Shizuoka-ken, Japan

[73] Assignee: Kabushiki Kaisha Kawai Gakki Seisakusho, Shizuoka, Japan

[21] Appl. No.: 08/945,427

[22] PCT Filed: May 2, 1996

[86] PCT No.: PCT/JP96/01204

§ 371 Date: Oct. 15, 1997

§ 102(e) Date: Oct. 15, 1997

[87] PCT Pub. No.: WO96/35206

PCT Pub. Date: Nov. 7, 1996

[30] Foreign Application Priority Data

May 2, 1995 [JP] Japan ..... 7-132953
Jan. 16, 1996 [JP] Japan ..... 8-023064

[51] Int. Cl.[6] ..... G10C 1/00

[52] U.S. Cl. ..... 84/174

[58] Field of Search ..... 84/174, 177, 184, 84/186.1, 438

[56] References Cited

U.S. PATENT DOCUMENTS

| | | |
|---|---|---|
| 2,486,338 | 10/1949 | Sperry et al. . |
| 2,505,804 | 5/1950 | Stein . |
| 2,836,093 | 5/1958 | Crippen . |
| 3,072,005 | 1/1963 | Quitter et al. . |
| 4,377,102 | 3/1983 | Mayerjak . |

FOREIGN PATENT DOCUMENTS

| | | |
|---|---|---|
| 54-104321 | 8/1979 | Japan . |
| 54-137018 | 9/1979 | Japan . |
| 54-157023 | 11/1979 | Japan . |
| 55-162289 | 11/1980 | Japan . |
| 58-65094 | 5/1983 | Japan . |
| 59-162591 | 9/1984 | Japan . |
| 63-29189 | 2/1988 | Japan . |

*Primary Examiner*—Jeffrey W. Donels
*Attorney, Agent, or Firm*—Evenson, McKeown, Edwards & Lenahan, PLLC

[57] ABSTRACT

There is provided a method of assembling an upright piano. The upright piano is divided into a plurality kinds of units. The plurality of kinds of units are each separately assembled, and these plurality of kinds of units thus assembled are joined to each other, to thereby assemble the upright piano.

22 Claims, 20 Drawing Sheets

(a)

(b)

(a)

(b)

METHOD OF ASSEMBLING AN UPRIGHT PIANO

TECHNICAL FIELD

This invention relates to a method of assembling an upright piano.

BACKGROUND ART

FIG. 23 is a conventional operation chart for assembling an upright piano, and FIG. 24 is a sectional side elevation showing the upright piano after assembly. Conventionally, the upright piano is typically assembled according to the following procedure:

(1) First, back posts 1, a bottom beam 2, a top beam 3, etc., are assembled into a back post assembly 5.

(2) After attaching a liner 71 to the back post assembly 5, a sound board 16 having sound ribs 18 and bridges 17 bonded thereto and a pin block 8 are mounted on the back post assembly 5.

(3) After a plate 21 is mounted on the back post assembly 5, and tuning pins 25 are embedded in the pin block 8 via the plate 21, strings W are stretched between the tuning pins 25 and hitch pins 22.

(4) End panels 35 having arms and other component parts attached thereto are fixed to respective opposite sides of the back post assembly 5, and a key bed 26 is mounted between the arms to be supported thereby. In mounting the key bed 26, to effect positioning of the key bed 26 with respect to the plate 21, it is conventionally known to engage dowel pins 76 provided on a front surface of the plate 21 with dowel holes 75 formed in a rear end face of the key bed 26, as shown in FIG. 25(*a*), thereby positioning the key bed 26 in a longitudinal direction (in the direction of depth of the figure) or alternatively, fix the rear end of the key bed 26 to the plate 21 via a pair of L-shaped mounting hardware pieces 77 attached to the plate 21 at respective left-hand and right-hand potions of the plate 21, as shown in FIG. 25(*b*), followed by fixing a front portion of the key bed 26, which is free to move in a vertical direction (in the directions of arrows in FIGS. 25(*a*) and 25(*b*)), to casing component parts, such as arms.

(5) Keys 27 are placed on the key bed 26 via a key frame 31, and action assemblies 28 equipped with respective hammer assemblies 29 are mounted on the key bed 26. The action assemblies 28 are supported by action brackets 72 each of which has an upper end thereof fixed to the back post assembly 5 by an action bracket bolt 73, and a lower end thereof fixed to the key bed 28 by an action bracket base, not shown.

(6) Regulation (adjustment of operations of each key 27 and the associated action assembly 28 for their correct string-striking actions) and tuning are carried out.

(7) Casing component parts 74, such as a top board 54, a lower panel 55, and an upper panel 56, are mounted, and voicing, finishing, and inspection are carried out to complete the assembly of the upright piano.

However, according to the conventional assembly method, the back post assembly 5 is used as a basis, and a large number of component parts, such as the liner 71, the sound board 16, the pin block 8, the plate 21, the strings W, the end panels 35, the key bed 26, the keys 27, and the action assemblies 28 have to be sequentially mounted. Therefore, all these component parts are usually assembled at the same site. As a result, vast space and large production facilities are required for storage of component parts and assembly work.

Such requirement restricts the freedom of selection of assembly sites, and reduces the mobility of production, which makes it difficult to meet the demand of a small or medium scale production or overseas production of pianos.

Further, according to the conventional assembly method, a large number of component parts are sequentially mounted using the back post assembly 5 as a basis, so that tolerances of component part and mounting errors tend to accumulate to bring the component parts out of alignment to a significant degree. Since the key bed 26 is assembled to both the plate 21 and the casing component parts, such as the arms, as described above, the key bed 26 deviates from its proper position with respect to the plate 21 if the plate 21 and the casing component parts are not properly positioned with respect to each other. The casing component parts are typically made of wood, and hence liable to manufacturing errors as well as deformations resulting from distortion and warpage occurring after assembly, so that a certain degree of deviation in position of the key bed 26 from the plate 21 is unavoidable. As a result, the keys 27 placed on the key bed 26, the associated strings W stretched over the plate 21, and the associated action assemblies 28 located therebetween go out of alignment, which requires the action assemblies 28 to be adjusted after assembly e.g. for proper string-striking actions at the cost of much time and labor. This is one of major factors which have been driving up the manufacturing cost of pianos.

Therefore, it is the object of the present invention to provide a method of assembling an upright piano, which makes it possible to assemble an upright piano efficiently and accurately, with smaller space and smaller-scale production facilities.

DISCLOSURE OF THE INVENTION

The method of assembling an upright piano as described in claim 1 is characterized by comprising the steps of separately assembling each of a plurality of kinds of units, and joining the plurality of kinds of units assembled, to each other, to thereby assemble the upright piano. According to the elements of the present method, the piano to be assembled is divided into a plurality of units, and these units are each separately assembled and then joined to each other, whereby the upright piano is assembled. Therefore, it is possible to manufacture the units at respective different site in a decentralized manner. This enables upright pianos to be assembled in smaller space with smaller production facilities as compared with conventional methods of assembling upright pianos. Further, since the mobility of production is thus increased, it is possible to comply with demand of small or medium scale production and overseas production of pianos.

Moreover, if adjustments are properly made unit by unit in advance, it is only required to adjust relative positions of the units after these units are joined to each other, which facilitates adjustment work after assembly.

Preferably, one of the plurality of kinds of units is a back post unit comprising a back post assembly which is assembled by framing outer back posts, a top beam, and a bottom beam. According to this construction, the outer back posts, etc. are framed into a back post assembly to form the back post unit, and other units can be joined to the back post assembly which serves as a basis in assembling the upright piano.

Preferably, the back post assembly is assembled by placing the outer back posts, the bottom beam, and the top beam, within a frame having predetermined inside dimensions, and joining the outer back posts, the bottom beam, and the top beam to each other, when the outer back posts, the bottom beam, and the top beam are in a state in which the outer back posts, the bottom beam, and the top beam are pressed against inner surfaces of the frame. According to this construction, the back post assembly having predetermined outside dimensions (width and height) equal to the corresponding inside dimensions of the frame can be easily and accurately made only by putting the outer back posts, etc. within the frame and joining them to each other. This makes it possible to completely abolish the secondary working of shaving the periphery of the back post assembly, which has been conventionally carried out to this end.

Preferably, the back post unit includes a bottom beam cover and an top beam cover attached to a rear surface of the back post assembly in a fashion covering the bottom beam and the top beam, respectively. According to this construction, even if gaps are produced between the outer back posts and the bottom beam or the top beam, the gaps are eventually covered by the bottom beam cover and the top beam cover, thereby preventing the gaps from adversely affecting appearance of the upright piano.

Preferably, the back post unit includes a pin block attached to an upper portion of a front surface of the back post assembly, the pin block being positioned with reference to an upper end surface of the back post assembly. According to this construction, the pin block forms part of the back post unit, and can be accurately positioned in a vertical direction with reference to the upper end surface of the back post assembly assembled with accuracy.

Preferably, one of the plurality of kinds of units is a sound board unit comprising a sound board, bridges attached to a front surface of the sound board, and sound ribs attached to a rear surface of the sound board, and the sound board is secured to the front surface of the back post assembly to thereby join the sound board unit to the back post unit. According to this construction, the sound board, the bridges, and the sound ribs constitute the sound board unit which is assembled separately from the back post unit. The sound board unit assembled is joined to the back post unit by fixing the sound board to the front surface of the back post assembly.

Preferably, the sound board unit includes a liner attached to a periphery of the rear surface of the sound board, the liner having a surface brought into contact with the sound board, the surface of the liner being formed with a predetermined inclined surface, the sound board being secured to the back post assembly by way of the liner. According to this construction, the liner forms part of the sound board unit, and before the sound board is secured to the back post assembly, the predetermined inclined surface of the liner can impart a predetermined slightly crowned shape to the sound board.

Preferably, when the sound board unit is joined to the back post unit, the sound board is positioned to a predetermined location with respect to the back post assembly by sound board-positioning means. According to this construction, when the sound board unit is joined to the back post unit, the sound board-positioning means enables the sound board to be accurately positioned to a predetermined location with respect to the back post assembly.

Preferably, one of the plurality of kinds of units is a frame unit including a plate and hitch pins arranged thereon, and the plate is fixed to the front surface of the back post assembly with the sound board interposed between the plate and the front surface of the back post assembly, to thereby join the frame unit to the back post unit. According to this construction, the plate and the hitch pins form the frame unit as a unit separate from the back post unit and the sound board unit, which promotes unitization of component parts of the upright piano, and the frame unit is joined to the back post unit by fixing the plate to the front surface of the back post assembly with the sound board interposed therebetween.

Preferably, when the frame unit is joined to the back post unit, the plate is positioned to a predetermined location with respect to the back post assembly by plate-positioning means. According to this construction, when the frame unit is joined to the back post unit, the plate-positioning means enables the plate to be accurately positioned to a predetermined location with respect to the back post assembly Preferably, when the frame unit is joined to the back post unit, space between a surface of the sound board and a surface of the plate opposed to each other is adjusted to a predetermined distance by means of a spacer interposed between the sound board and the plate. According to this construction, the space between the sound board and the plate can be adjusted to a predetermined length by the spacer, which makes it possible to obtain a predetermined level of bridge pressure with ease.

Preferably, one of the plurality of kinds of units is a string unit comprising a multiplicity of string assemblies, each of the string assemblies having a string and two tuning pins around which ends of the string are wound, respectively. According to this construction, the strings and tuning pins form the string unit as a unit separate from the back post unit, the sound board unit and the frame unit, which further promotes unitization of component parts of the upright piano.

Preferably, the two tuning pins of the each of the string assemblies are embedded in a pin block provided on the back post unit, and the string is engaged with a corresponding one of the hitch pins of the frame unit, and then stretched. Thus, each string is wound around the tuning pins in advance, and after the resulting tuning pins are embedded in the pin block, the string is stretched. Therefore, the string can be made tight while easily adjusting turns of coiled portions of the string around the tuning pins to prevent gaps from being produced between the turns, from a state in which the string is loosely stretched. This makes it possible to dispense with what is called "sliding-up adjustment", i.e. a conventional adjustment operation of sliding up the turns with a coil-lifting device and driving down the tuning pins with a screw driver, thereby facilitating stretching of the strings.

Preferably, one of the plurality of kinds of units is a mechanical unit comprising a key bed, and keys, action assemblies, hammer assemblies and damper assemblies mounted on the key bed, and the mechanical unit is joined to the frame unit by securing the key bed to the plate. According to this construction, the unitization of component parts of the upright piano is further promoted by forming the mechanical unit by mounting the action assemblies, the hammer assemblies, and the damper assemblies on the key bed. Further, since the key bed is directly secured to the plate, it is unnecessary to fix the key bed to casing component parts, such as arms, so that the alignment between the plate and the casing component parts does not affect the accuracy of attaching the key bed to the plate.

Preferably, the key bed is secured to the plate by way of a plurality of key bed stays fixed to the plate, each of the plurality of key bed stays having dowel pins and/or dowel holes provided at respective predetermined locations in a rear surface thereof, the plate having a plurality of key bed stay-positioning dowel holes and/or key bed stay-positioning dowel pins provided at respective predetermined locations in a front surface thereof, the each of the plurality of key bed stays being secured to the plate, in a state in which the dowel pins and/or the dowel holes of the plurality of key bed stays are engaged with the key bed stay-positioning dowel holes and/or the key bed stay-positioning dowel pins of the plate. According to this construction, by securing the key bed stays to the plate in a state in which the dowel pins and/or the dowel holes of the key bed stays are engaged with the key bed stay-positioning dowel holes and/or the key bed stay-positioning dowel pins of the plate, it is possible to accurately position the key bed stays and hence the key bed fixed thereto to respective predetermined locations in vertical and longitudinal directions with respect to the plate.

Preferably, the key bed is slid on the key bed stays in a transverse direction by guiding the key bed by key bed guide means to thereby fix the key bed to the key bed stays at a predetermined location in the transverse direction. According to this construction, the key bed can be adjusted to a predetermined location in a transverse direction, and then fixed thereto. Therefore, the key bed can be secured to the plate by way of the key bed stays when the key bed is in a state positioned to a predetermined location in vertical, longitudinal and transverse directions with respect to the plate. In this case, since the key bed is secured to the plate without any casing component parts interposed therebetween, completely independently of the casing component parts, the alignment between the plate and the casing component parts does not affect the accuracy of attaching the key bed to the plate. As a result, the key bed can be attached to the plate at a predetermined three-dimensional location with accuracy, which enables operations of adjusting the action assemblies, such as string-striking action adjustment, to be carried out very easily.

Preferably, the key bed guide means is formed by a guide slot formed in a front end portion of the each of the plurality of the key bed stays in a fashion extending in the transverse direction, and the key bed has screws each attached to a bottom of a front portion of the key bed for engagement with the guide slot. According to this construction, the key bed is guided in a transverse direction by the screws attached to the bottom of the front portion of the key bed and the guide slots formed in the key bed stays, and is fixed to the key bed stays by fastening the screws. Thus, the key bed is secured to the key bed stays by the screws while restricting the front portion of the key bed in respect of the motion thereof in the longitudinal direction by the guide slots, whereby it is made possible to secure the key bed while reliably preventing the key bed from deviating in its position in a longitudinal direction. Further, these advantageous effects can be obtained by relatively simple construction which merely employs the screws and the guide slots.

Preferably, the guide slot opens in a front end surface of the key bed stay. According to this construction, the screws are attached to the bottom of the key bed in advance, and then, after the key bed is placed on the key bed stays, it is slid to the rear side to easily causes the screws to be engaged with the guide slots opening in the front end surface of the key bed stays, which makes it possible to secure the key bed to the key bed stays even more easily.

Preferably, the plate having key bed-positioning dowel holes and/or key bed-positioning dowel pins provided at respective predetermined locations of a front surface thereof, and the key bed has a rear end surface formed with dowel pins and/or dowel holes for engagement with the key bed-positioning dowel holes and/or key bed-positioning dowel pins of the plate. According to this construction, the engagement of the key bed-positioning dowel holes and/or the key bed-positioning dowel pins of the plate with the dowel pins and/or the dowel holes of the key bed enables the key bed to be directly positioned to a predetermined location in vertical and longitudinal directions with respect to the plate, which makes it possible to join the key bed to the plate with higher accuracy. Particularly, when the plurality of key bed stays are formed as a pair for the right and left sides of the upright piano, bending-down of an inner portion of the key bed can be prevented in a reliable manner by providing the key bed-positioning dowel holes and/or key bed-positioning dowel pins at inner portions of the plate.

Preferably, the mechanical unit is regulated in advance before the mechanical unit is joined to the frame unit. According to this construction, positions of the keys, the action assemblies, the hammer assemblies, and the damper assemblies on the key bed are properly adjusted with respect to each other, whereby in cooperation of the key bed directly attached to the plate with accuracy, adjustment operations of the action assemblies after the mechanical unit is joined to the other units can be effected even more easily. For example, if the action assemblies and the corresponding strings are slightly out of alignment, adjustment work can be easily carried out by merely moving the whole key bed relative to the plate for fine adjustment.

Preferably, the key bed is formed by framing a plurality of hollow metal profiles. According to this construction, the key bed is made of metal, with small manufacturing errors and high dimensional stability, which enhances the dimensional accuracy of the key bed itself, which leads to enhanced accuracy of assembling of the same to the other units. Further, since the key bed is formed by framing a plurality of hollow profiles, the weight of the upright piano can be reduces as well.

Preferably, one of the plurality of kinds of units is a casing unit which is assembled by joining at least end panels, arms, and toe blocks, to each other. According to this construction, part of the casing component parts, such as end panels, is incorporated into the casing unit, whereby unitization of component parts of the upright piano is further promoted.

Preferably, one of the plurality of kinds of units is a pedal unit which is assembled by joining at least a bottom board and pedal component parts, to each other. According to this construction, the pedal component parts are also incorporated into the pedal unit together with the bottom board, whereby unitization of component parts of the pedal unit is further promoted.

BEST MODE OF CARRYING OUT THE INVENTION

Figure 1:
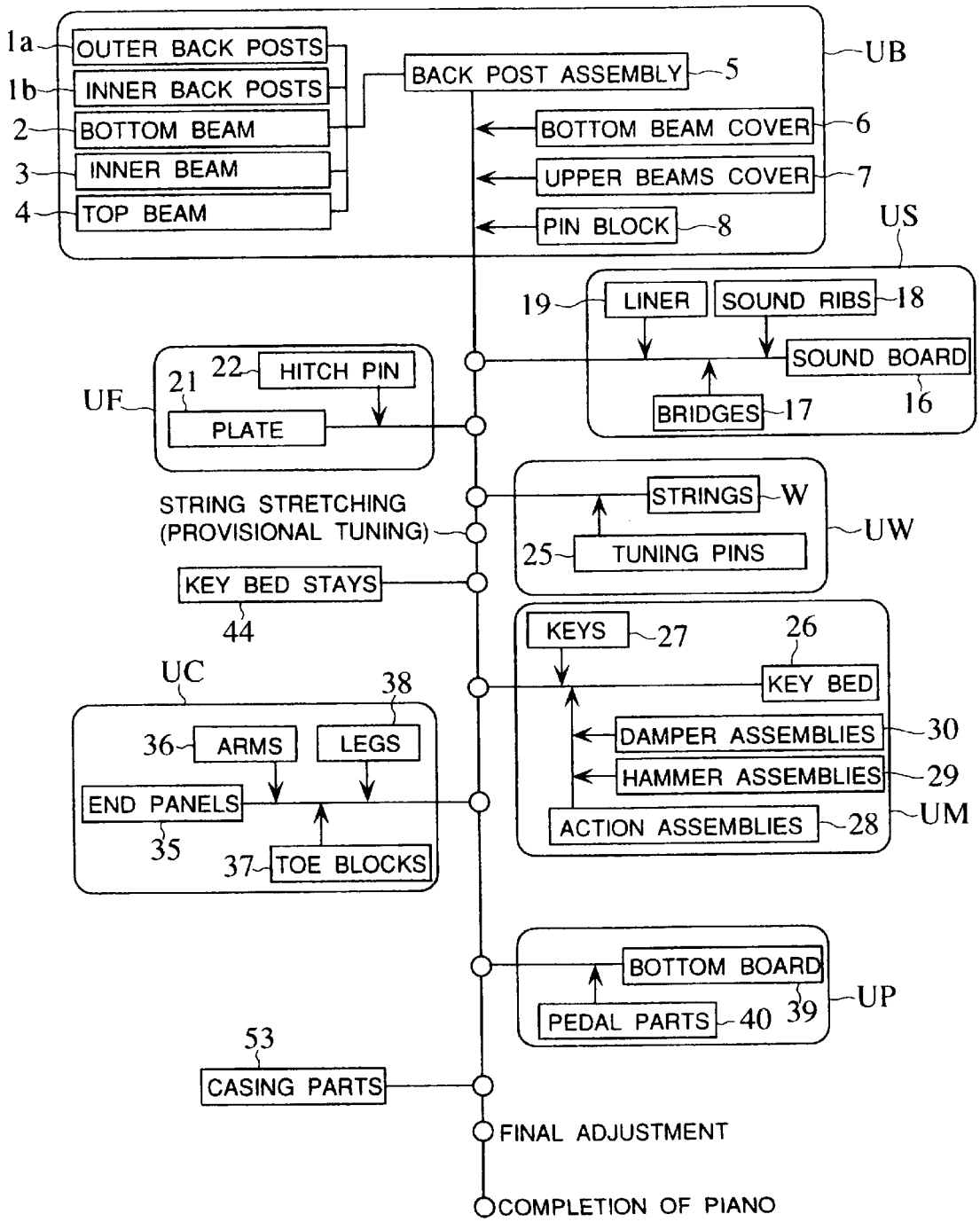
FIG. 1 is an operation chart illustrating a method of assembling an upright piano, according to a first embodiment of the invention.
Figure 23:
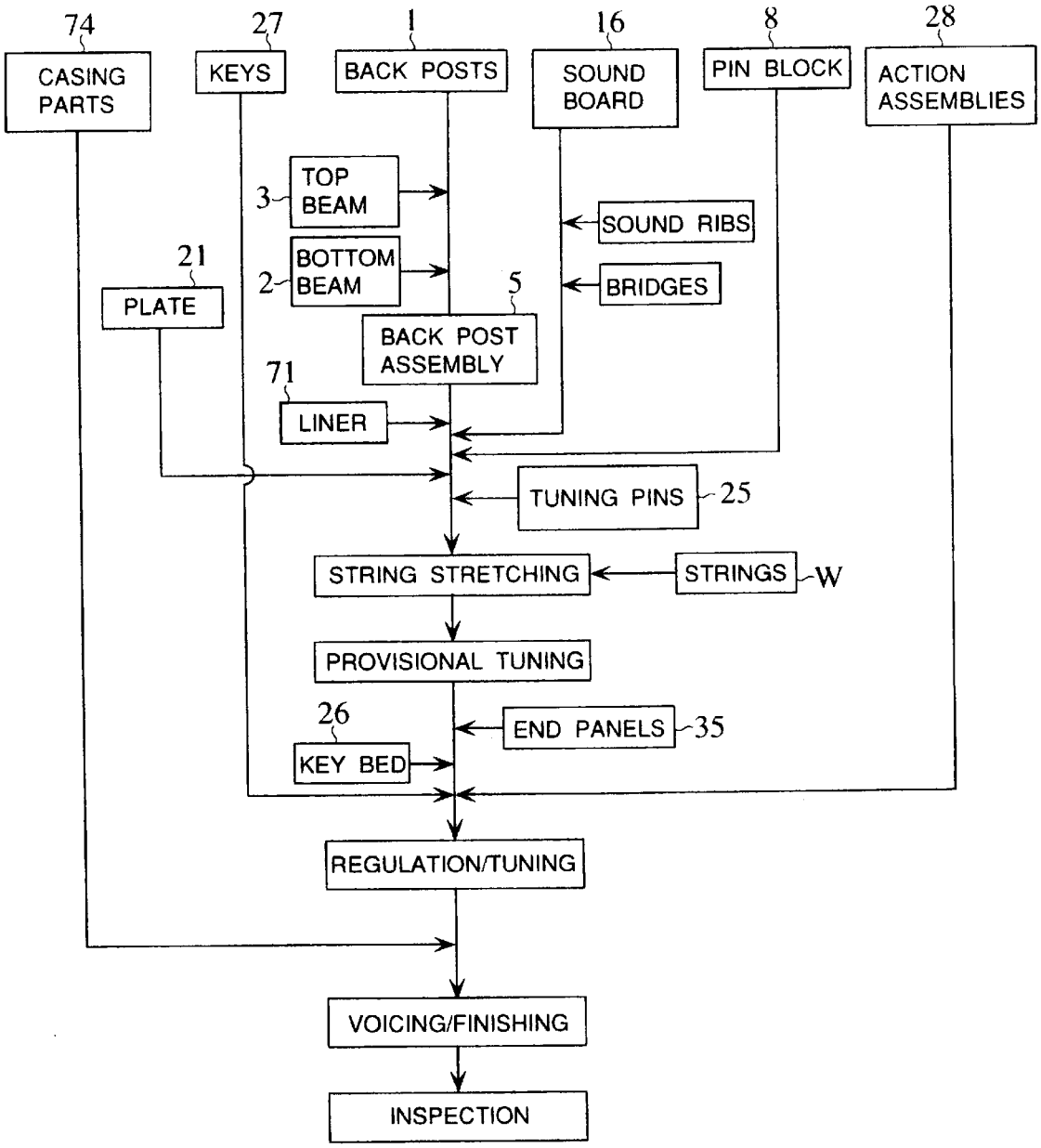
FIG. 23 is an operation chart showing a conventional method of assembling an upright piano.
Figure 24:
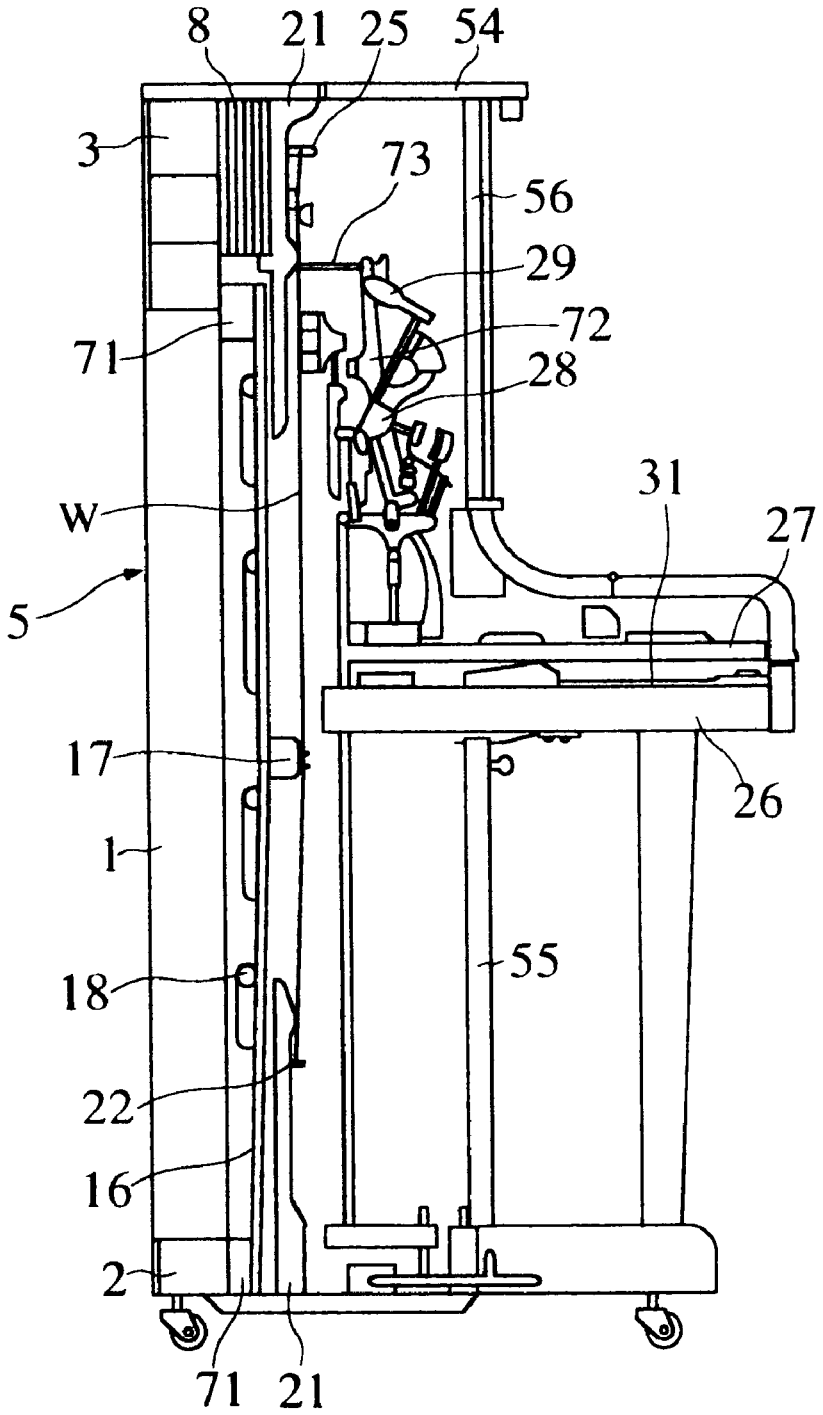
FIG. 24 is a sectional side elevation showing an upright piano assembled according to the conventional method.
Figure 25:
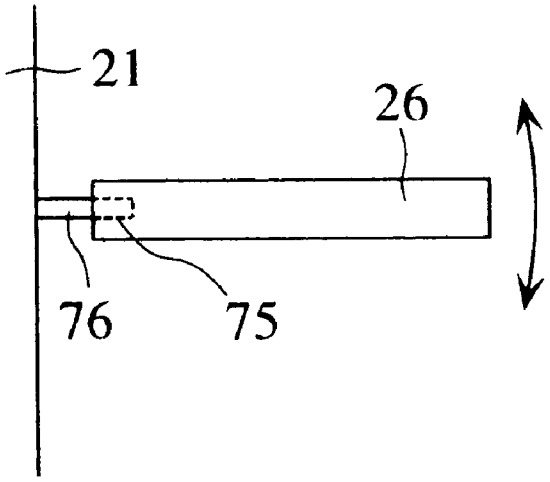
FIG. 25 consists of side elevations schematically illustrating a conventional manner of joining a key bed.
Figure 25:
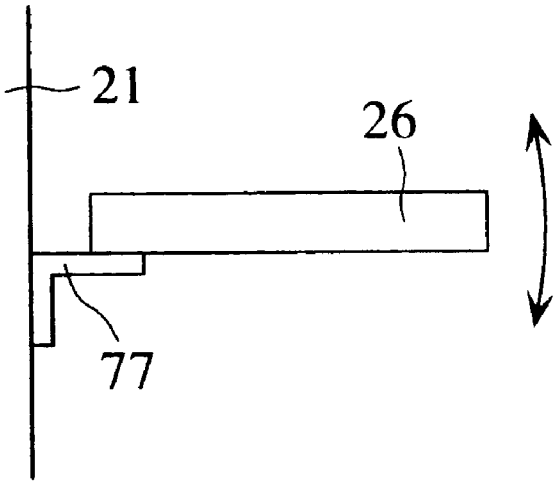

Preferred embodiments of the present invention will now be described in detail with reference to drawings. FIG. 1 shows process steps of a method of assembling an upright piano according to a first embodiment of the invention. As shown in the figure, according to the present method, the upright piano is divided into seven units: a back post unit UB, a sound board unit US, a frame unit UF, a string unit UW, a mechanical unit UM, a casing unit UC, and a pedal unit UP. These units are each separately and independently assembled, and then joined to each other into a complete piano assembly shown in FIG. 2. The process steps of assembling respective units and the process steps of joining units will be described in the mentioned order. It should be noted that, in the following description, component parts corresponding to those described hereinabove with reference to FIGS. 23 to 25 are commonly designated by identical reference numerals.

1. Back post unit-assembling step

Figure 3:
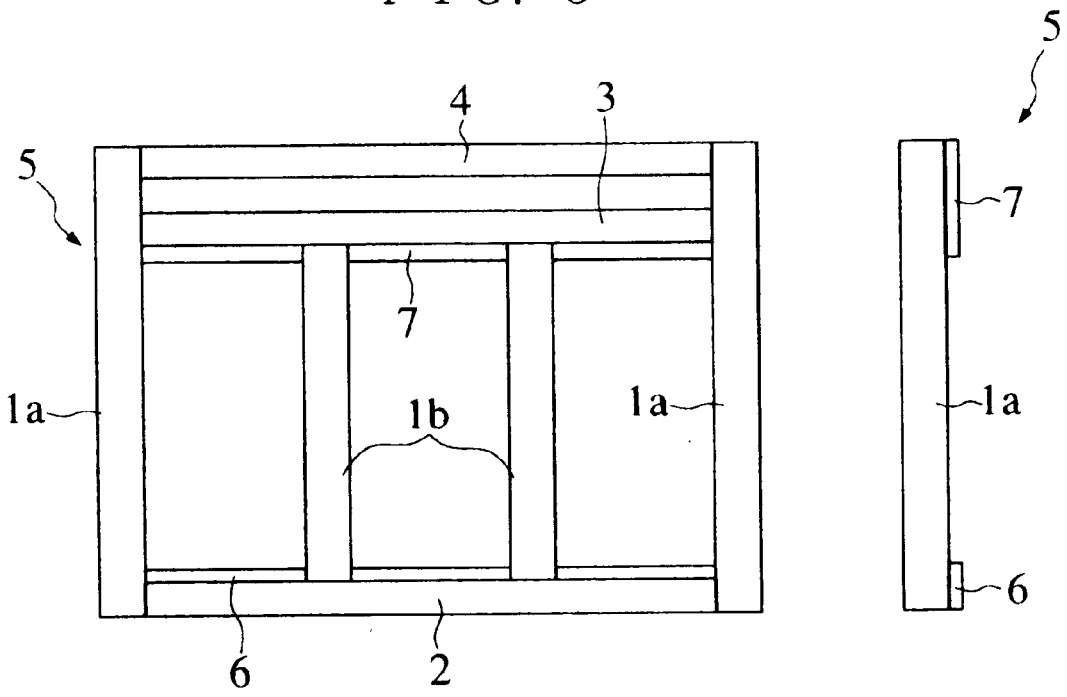
FIG. 3 consists of a front elevation and a side elevation showing a back post unit without a pin block.

Referring to FIG. 3, the back post unit UB is comprised of a back post assembly 5 formed of outer back posts 1*a,* 1*a* and inner back posts 1*b,* 1*b* located inside of the outer back posts 1*a,* 1*a,* a bottom beam 2, an inner beam 3, and a top beam 4 each of which laterally extends between the outer back posts 1*a,* 1*a,* a bottom beam cover 6 and an upper beams cover 7 attached to a rear face of the back post assembly 5, and a pin block 8 (see FIG. 6) mounted on front faces of the inner beam 3 and the top beam 4.

Figure 4:
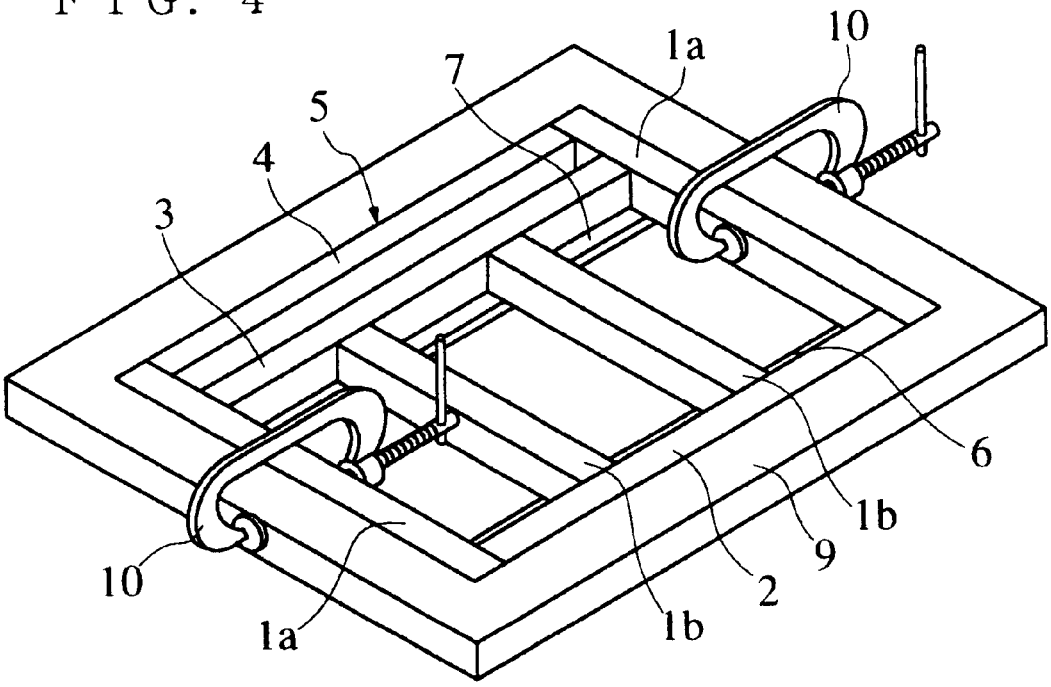
FIG. 4 is a perspective view illustrating a manner of assembling a back post assembly of the back post unit.
Figure 5:
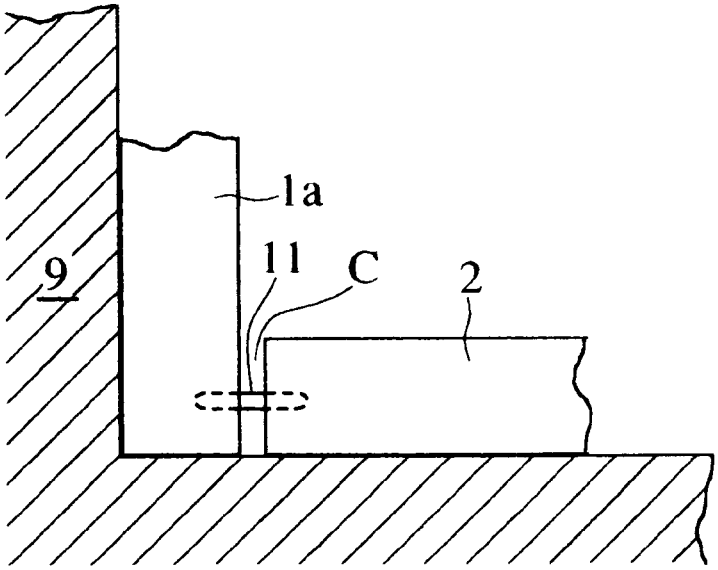
FIG. 5 consists of enlarged fragmentary front elevations illustrating a manner of assembling the back post assembly.
Figure 5:
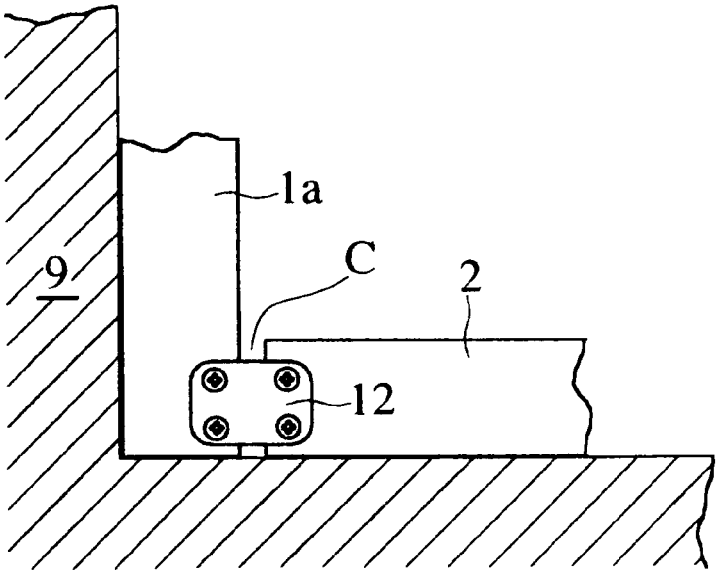

The back post assembly 5 is assembled with the aid of a frame 9, as shown in FIG. 4. The frame 9 is formed of a material having a high rigidity, such as wood or iron, and designed such that it has predetermined inside dimensions. Component parts of the back post assembly 5, i.e. the outer back posts 1*a,* the inner back posts 1*b,* the bottom beam 2, the inner beam 3, and the top beam 4 are placed within the frame 9. Then, in a state in which the outer back posts 1*a,* the bottom beam 2, and the top beam 4 are fastened to the inner surfaces of the frame 9 by means of clamps 10 or the like, i.e. in a state in which these component parts are positioned with respect to each other with reference to the inner surfaces of the frame 9, the component parts are joined to each other. The joining of these component parts is carried out, e.g. in a manner as shown in FIG. 5, using positioning dowels 11 in combination with the frame 9, and fixing hardware devices 12. Thereafter, the bottom beam cover 6 and the upper beams cover 7 are bonded to the rear face of subassembly of the back post assembly 5 thus assembled to cover the bottom beam 2, and the inner beam 3 and the top beam 4, respectively.

According to this method of assembling the back post assembly 5, the back post assembly having predetermined outside dimensions (width and height) equal to the inside dimensions of the frame 9 can be easily obtained with accuracy only by placing the component parts within the frame 9 and joining them to each other. This makes it possible to completely abolish secondary working of shaving the periphery of the back post assembly, which has been conventionally carried out to this end. Further, even if a gap C is produced between the outer back posts 1*a,* and the bottom beam 2 or the top beam 4 (see FIG. 5) during assembling of the back post assembly, the gap C is eventually covered by the bottom beam cover 6 and the upper beams cover 7, which prevents the gap C from adversely affecting the appearance of the piano.

Figure 6:
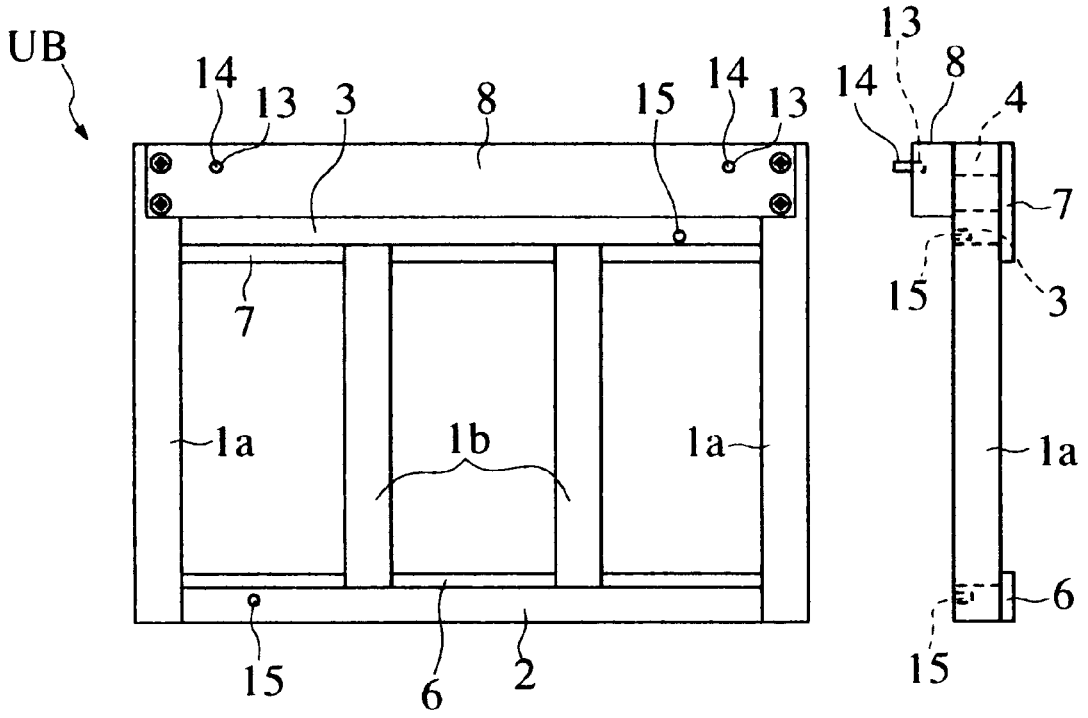
FIG. 6 consists of a front elevation and a side elevation showing the back post assembly completely assembled.

After assembling the back post assembly 5, as shown in FIG. 6, the pin block 8 is positioned with reference to an upper end surface of the back post assembly 5, and then the pin block 8 is fixed to the front faces of the inner beam 3 and the top beam 4 with screws, using an adhesive in combination. This makes it possible to accurately position the pin block 8 in a vertical direction. Then, two back assembly-positioning dowel holes 13, 13 are made in the pin block 8 at respective predetermined locations with reference to the upper end surface of the back post assembly 5 and a bass-side surface of the same, and back assembly-positioning dowel pins 14, 14 are hammered in the back assembly-positioning dowel holes 13, 13, respectively. Further, two sound board unit-positioning dowel holes 15, 15 are made in the bottom beam 2 and the inner beam 3 at respective predetermined locations on an diagonal line determined with reference to the back assembly-positioning dowel pins 14, followed by terminating the present process step.

2. Sound board unit-assembling step

Figure 7:
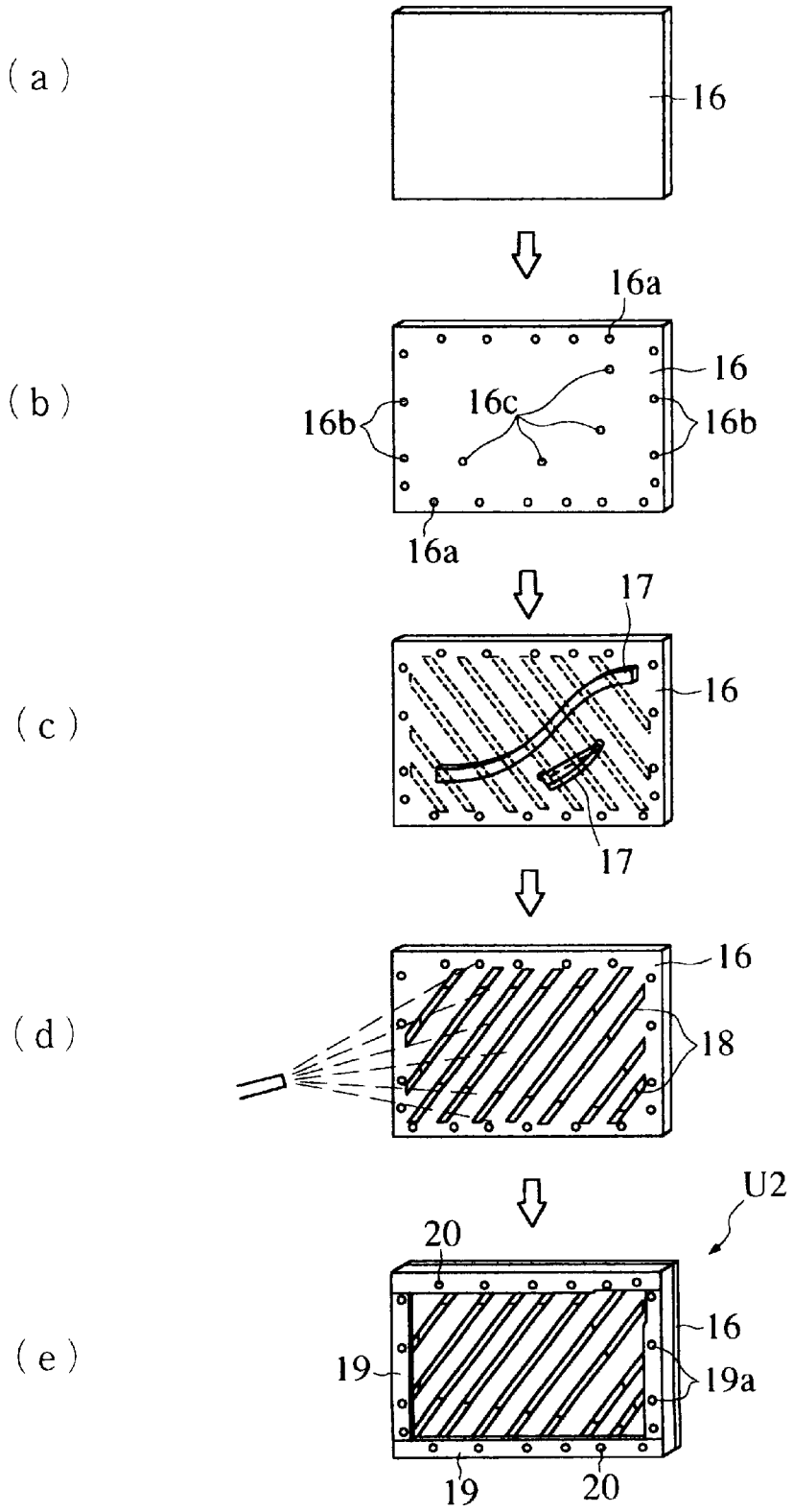
FIG. 7 illustrates a procedure of making a sound board unit.

The sound board unit US is comprised of a sound board 16, bridges (a short bridge and a long bridge) 17, sound ribs 18, and a liner 19. The procedure of assembling this unit is illustrated in FIG. 7. First, the sound board 16 is formed (see FIG. 7(*a*)) by joining opposed sides of adjacent ones of plates e.g. made of spruce material, and a large number of holes are formed through the sound board 16 at respective predetermined locations by NC processing (see FIG. 7(*b*)). These holes include two sound board unit-positioning dowel holes 16*a,* 16*a* formed through the sound board 16 in a manner corresponding to the sound board unit-positioning dowel holes 15, 15 of the back post assembly 5, a large number of sound board unit-joining holes 16*b* formed through portions of the periphery of the sound board 16, and bridge-attaching holes 16*c* formed in respective inner portions of the sound board 16. Next, the bridges 17 are bonded to a front surface of the sound board 16 by fitting the same in the bridge-attaching holes 16*c* (see FIG. 7(*c*)), respectively, and the sound ribs 18 are bonded to a rear surface of the sound board 16, followed by applying paint on the resulting subassembly (see FIG. 7(*d*)).

Figure 8:
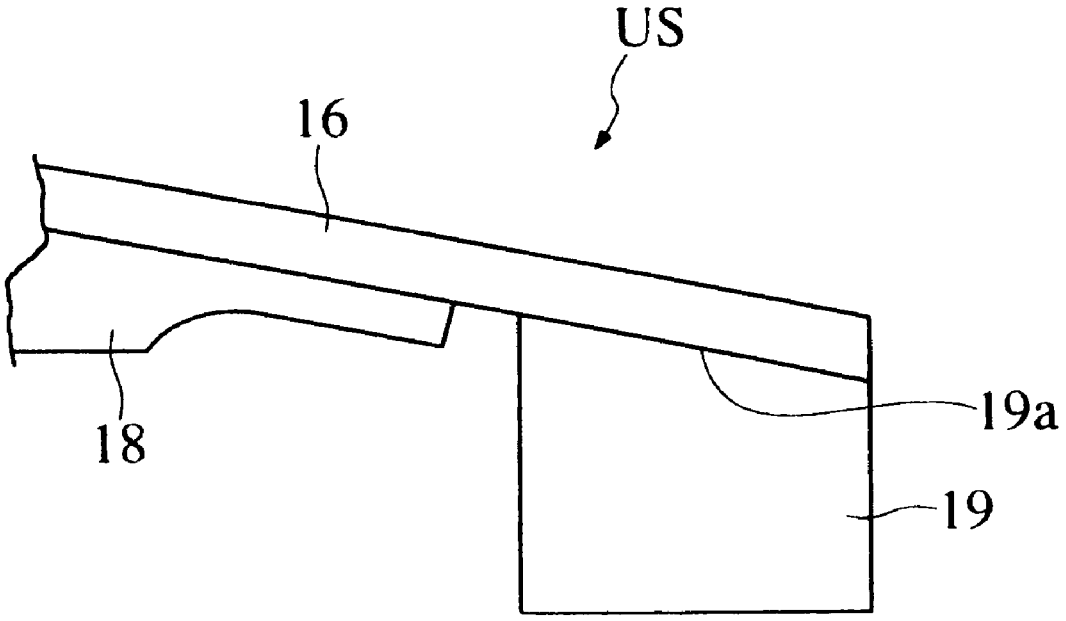
FIG. 8 is an enlarged view showing an end of the sound board unit.
Figure 9:
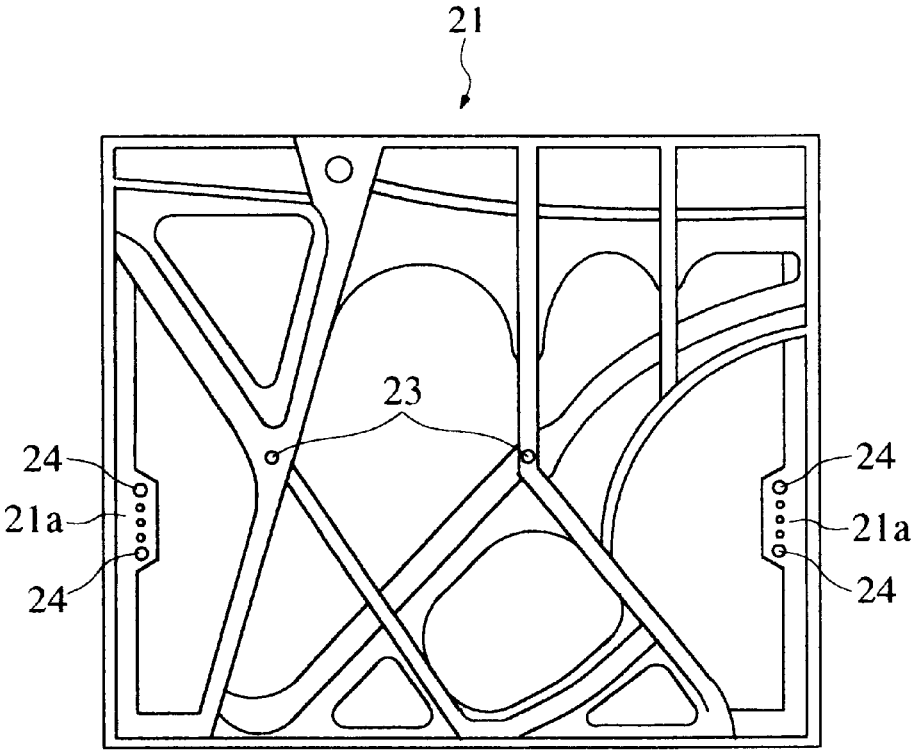
FIG. 9 is a front elevation showing a plate.

Next, as shown in FIG. 7(*e*), the liner 19 is bonded to the front peripheral area of the sound board 16 to complete the sound board unit US. The positioning of the liner 19 with respect to the sound board 19 can be carried out with accuracy by aligning the sound board unit-positioning dowel holes 16*a* and the sound board unit-joining holes 16*b* of the sound board 16 with through holes 19*a* formed through the liner 19, respectively, and inserting a dowel 20 in each aligned pair of the holes 16*a,* 16*b* and 19*a*. Further, as shown in FIG. 8, a surface of the liner 19 via which the liner 19 is bonded to the sound board 16 is cut in advance to form an inclined surface 19*a* having a predetermined angle of inclination to impart a correct slightly crowned shape to the sound board 16.

3. Frame unit-assembling step

The frame unit UF is formed by a plate 21 and hitch pins 22. In this process step, first, the plate 21 is formed by casting. The plate 21 is rectangular in elevation, with flat key bed stay-attaching portions 21*a,* 21*a* being formed on opposite lateral side portions of a front surface thereof for attaching key bed stays, referred to hereinafter, thereto. Then, a large number of various holes, such as hitch pin holes (not shown), are formed at predetermined locations in the plate 21 by NC processing, and then key bed-positioning dowel pins 23, 23, are embedded in two (right and left) holes formed at respective predetermined locations in the front surface of the plate 21. The holes formed in the plate 21 include two (upper and lower) key bed stay-positioning dowel holes 24, 24 formed in each of the key bed stay-attaching portions 21*a*. Then, the hitch pins 22 are hammered into the hitch pin holes, followed by terminating the present process step.

4. String unit-assembling step

Figure 10:
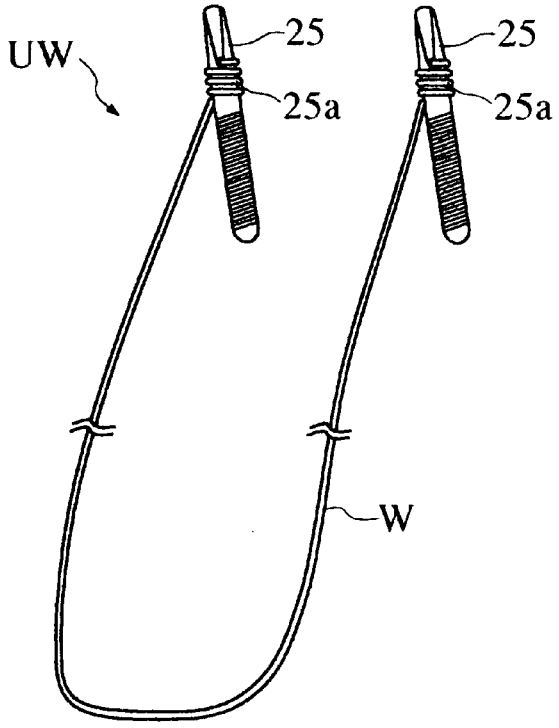
FIG. 10 is a perspective view showing one of string assemblies of a string unit.

The string unit UW is comprised of a multiplicity of string assemblies each being comprised, as shown in FIG. 10, of a pair of tuning pins 25, 25, and a string W formed of a wire and having opposite ends thereof respectively wound around the pair of tuning pins 25, 25. Each string assembly is assembled by inserting one end of the string W into a hole, not shown, formed through one of the pair of tuning pins 25 and winding the string W around the one tuning pin 25 into approximately three and half turns, and then similarly having the other end of the string W wound around the other tuning pin 25.

5. Mechanical unit-assembling step

Figure 11:
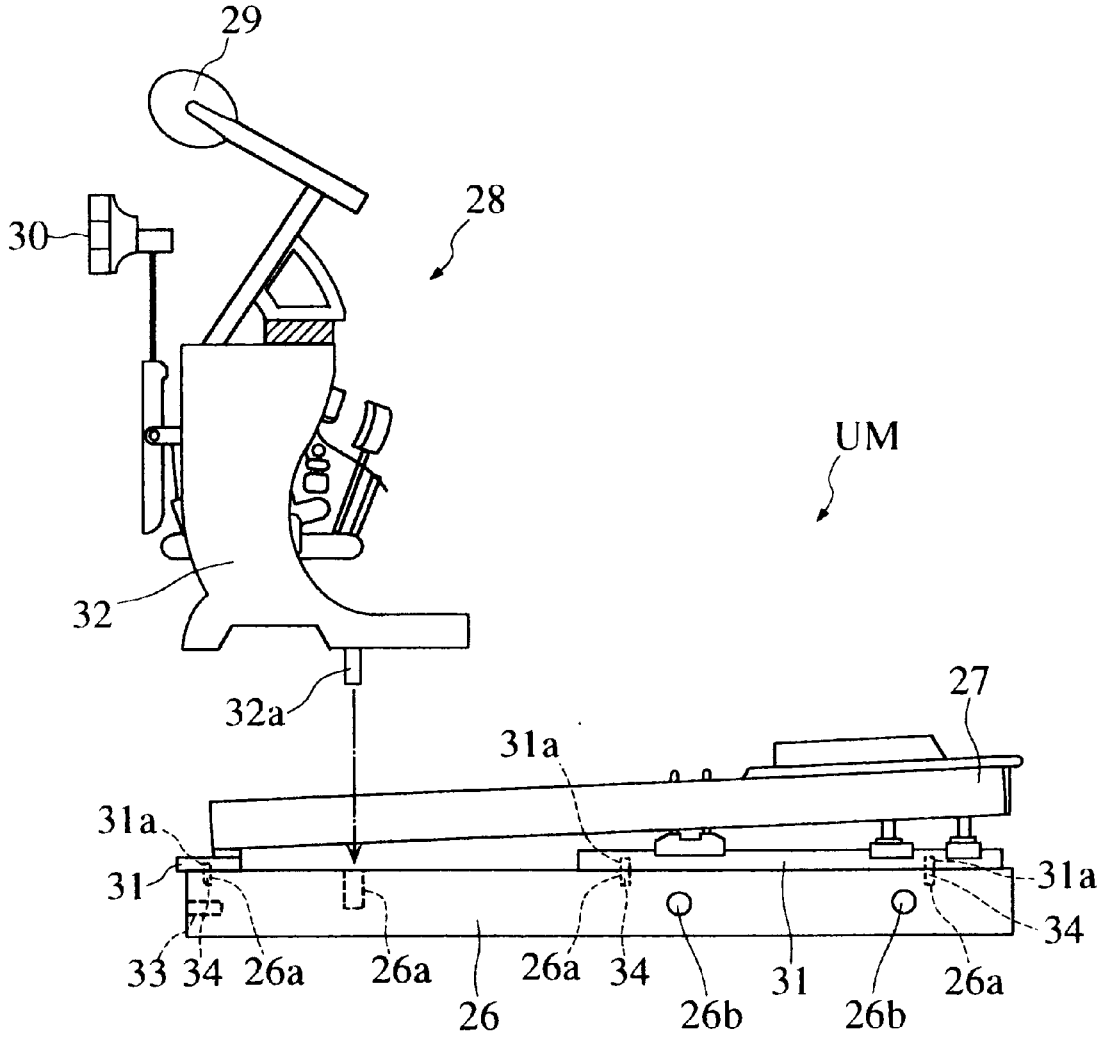
FIG. 11 is a side elevation showing a mechanical unit.

As shown in FIG. 11, the mechanical unit UM is comprised of a key bed 26, keys 27, action assemblies 28, hammer assemblies 29, and damper assemblies 30, and further provided with a key frame 31 for mounting the keys 27 on the key bed 26, and action brackets 32. The key bed 26 is formed by framing hollow profiles of metal, such as iron, into assembly, which makes it possible to reduce the weight as well as attain high dimensional accuracy and stability. The key bed 26 has a rear end face formed with two plate-positioning dowel holes 33, one of which is shown, at respective predetermined locations corresponding to the key bed-positioning dowel pins 23, 23 of the plate 21.

In assembling the mechanical unit UM, first, the key frame 31 is secured to the key bed 26 with screws, and the keys 27 are mounted on the key frame 31 to be supported thereby. In the securing of the key frame 31 to the key bed 26, dowel holes 31*a* formed in a bottom of the key frame 31, dowel holes 26*a* formed in a top of the key bed 26, and dowels 34 inserted in respective corresponding ones of the dowel holes 31*a* and 26*a* are employed, to thereby accurately position the keys 27 at predetermined locations with respect to the key bed 26.

Then, after the hammer assemblies 29 and the damper assemblies 30 are respectively mounted on the action assemblies 28 supported by the action brackets 32, the action brackets 32 are mounted on the key bed 26. In the mounting of each action bracket 32 on the key bed 26, a dowel pin 32*a* and a corresponding one of the dowel holes 26*a* as shown in FIG. 11 are utilized to thereby accurately position the action assemblies 28 and the other assemblies associated therewith at respective predetermined locations with respect to the key bed 26. Then, after the strings are stricken for running-in of the action assemblies 28, the whole mechanical unit UM is set up on a provisional regulating back unit, not shown, and regulation is carried out. Further, the damper pressure regulation is carried out to complete the mechanical unit UM. As described above, the mechanical unit UM is accurately adjusted in advance such that the keys 27, the action assemblies 28, the hammer assemblies 29, and the damper assemblies 30 are in correct alignment with each other or properly positioned with respect to each other with reference to the key bed 26.

6. Casing unit-assembling step

Figure 17:
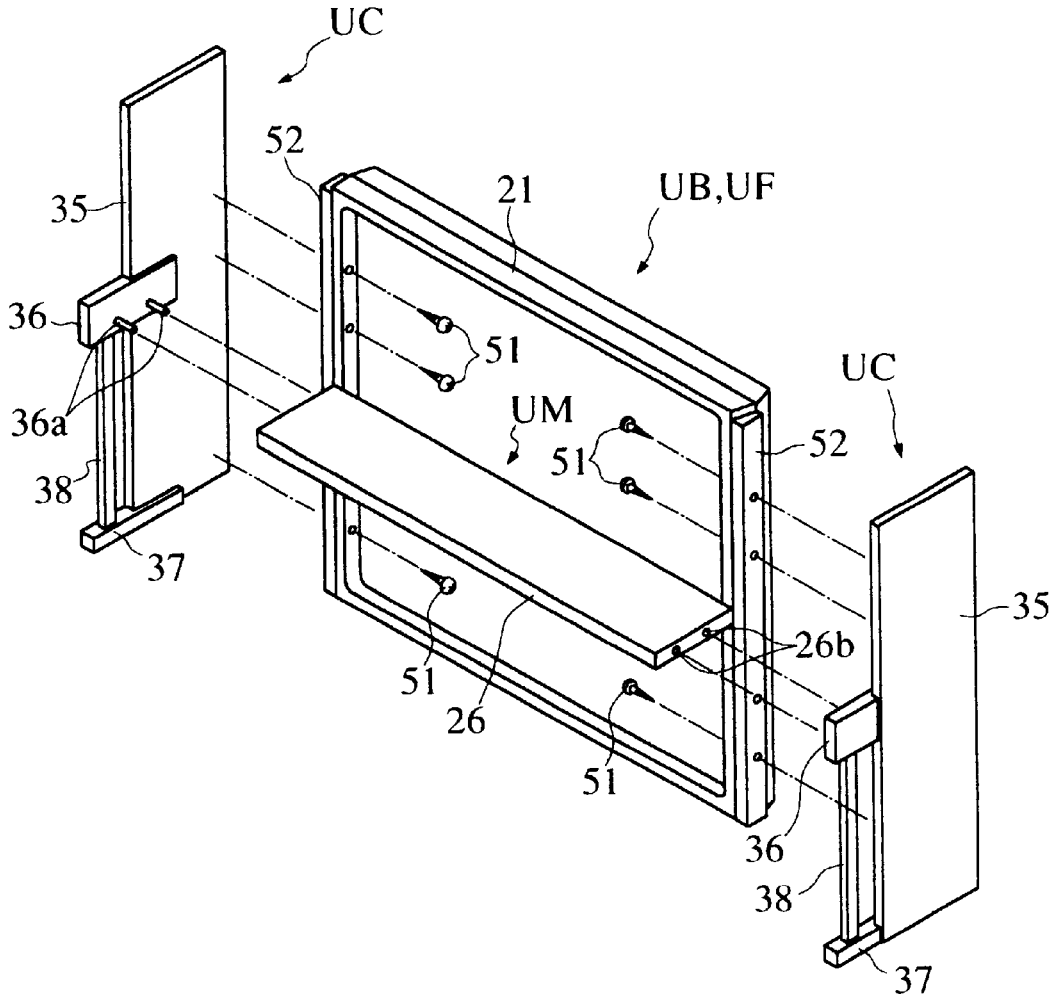
FIG. 17 is a perspective view illustrating a manner of joining a casing unit.

The casing unit UC is comprised of a pair of (left and right) units each formed beforehand by assembling an end panel 35, an arm 36, a toe block 37, and a leg 38 (see FIG. 17).

7. Pedal unit-assembling step

The pedal unit UP is comprised of a bottom board 39 and pedal component parts 40, i.e. pedals 40*a,* pedal levers 40*b,* and pedal rods 40*c*.

Next, the units UB, US, UF, UW, UM, UC and UP thus assembled are joined to each other using the back post unit UB as a basis according to the following unit-joining steps.

8. Sound board unit-joining step

Figure 12:
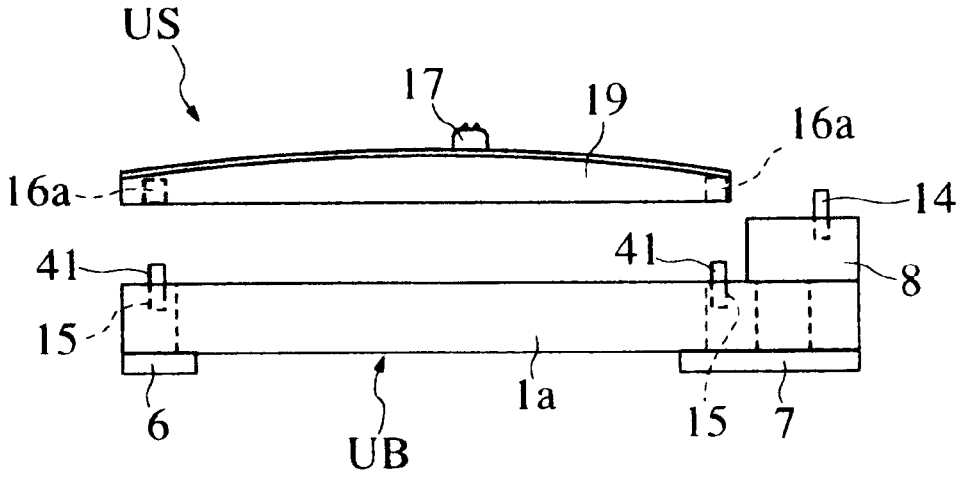
FIG. 12 is a view illustrating a manner of joining the sound board unit to the back post unit.

First, the sound board unit US is joined to the back post unit UB. At this process step, as shown in FIG. 12, the units UB and US are accurately positioned with respect to each other by laying the back post unit UB flat on the floor, aligning the sound unit-positioning dowel holes 15, 15 formed in the back post unit UB to the sound board unit-positioning dowel holes 16*a,* 16*a* formed in the sound board unit US, and plugging a dowel 41 in each corresponding pair of the dowel holes. That is, in the present embodiment, the sound board unit-positioning dowel holes 15, 16*a* and the dowels 41 form sound board-positioning means. After the positioning of the units UB and US, they are joined to each other by means of screws driven into the sound board unit-joining holes 16*b* of the sound board unit US, followed by terminating the present process step.

9. Frame unit-joining step

Figure 13:
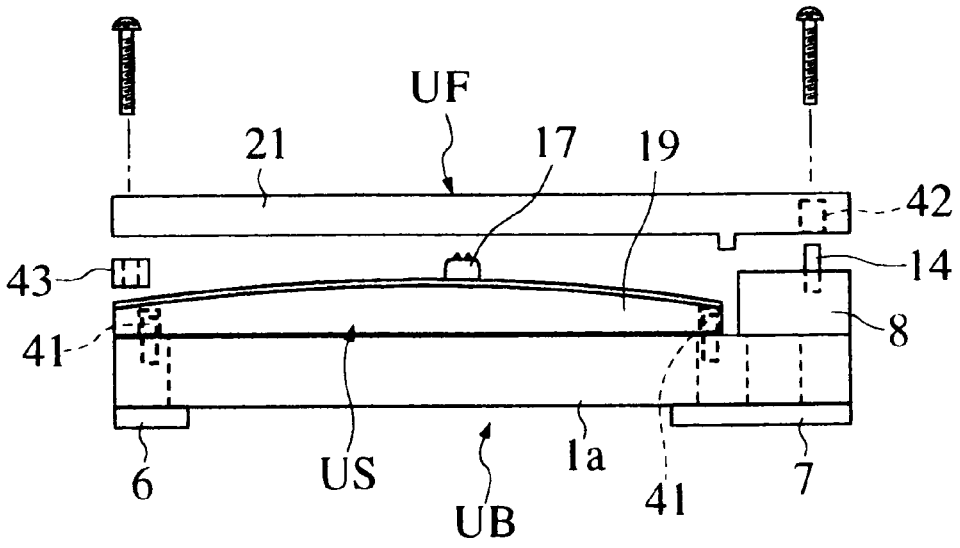
FIG. 13 is a view illustrating a manner of joining a frame unit to the back post unit.

Then, the frame unit UF is joined to a sound board-side surface of assembly of the units UB and US joined to each other. That is, as shown in FIG. 13, plate dowel holes 42 formed in the plate 21 in a manner corresponding to the back assembly-positioning dowel pins 14 embedded in the pin block 8 of the back post unit UB are fitted on the back assembly-positioning dowel pins 14, thereby effecting positioning of the frame unit UF. In other words, in the present embodiment, the back assembly-positioning dowel pins 14 and the plate dowel holes 42 form plate-positioning means. In a state thus positioned, the plate 21 is secured to the pin block 8 with screws such that the rear surface of the plate 21 is tightly attached to the front surface of the pin block 8, thereby joining the frame unit UF to the assembly of the units UB, US. In the joining of the frame unit UF, a spacer 43 having a predetermined thickness is inserted between the frame unit UF and part of the assembly of the units UB and US other than the pin block 8. This holds the front surface of the sound board 16 a predetermined distance away from the rear surface of the plate 21, thereby making it possible to easily obtain a predetermined level of bridge pressure.

10. String unit-assembling step

Next, the string unit UW is joined to assembly of the units UB, US and UF. In the joining of the string unit UW, first, tuning pin bushings, not shown, are hammered into respective holes formed through the plate 21, and then starting holes are made in the pin block 8 via the tuning pin bushings, respectively. The tuning pins 25 of the string unit UW are driven into the starting holes, respectively, and the strings W each having opposite ends thereof wound around the associated tuning pins 25 are hooked on the hitch pins 22. Then, each tuning pin 25 is turned to stretch the string W while effecting adjustments for neat appearance of a coiled portion 25*a* of the string W wound around the tuning pin 25 such that there is produced no substantial gap between the turns. Further, provisional tuning is carried out, followed by terminating the present process step.

Thus, the ends of the string W are wound around the tuning pins 25 in advance, and after the tuning pins 25 are driven through the plate 21 into the pin block 8, the strings W are stretched or made tight. Therefore, each string W can be made tight, from a state in which it is loosely stretched, while easily adjusting turns of the coiled portions 25*a* of the string W around the associated tuning pins 25 to make the tuns neat without any substantial gaps formed therebetween. Therefore, it is possible to dispense with what is called "sliding-up adjustment", i.e. a conventional adjustment operation of sliding up the turns with a coil-lifting device and driving down the tuning pins with a screw driver, which facilitates stretching of the strings W.

11. Mechanical unit-joining step

Figure 14:
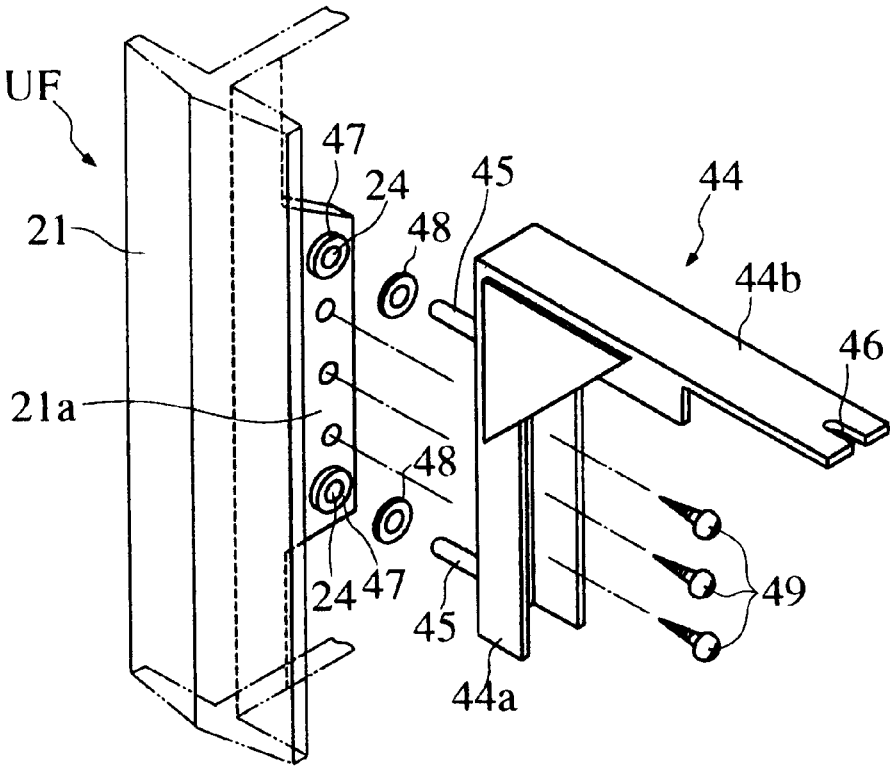
FIG. 14 is a perspective view illustrating a manner of attaching a key bed stay to the plate.
Figure 15:
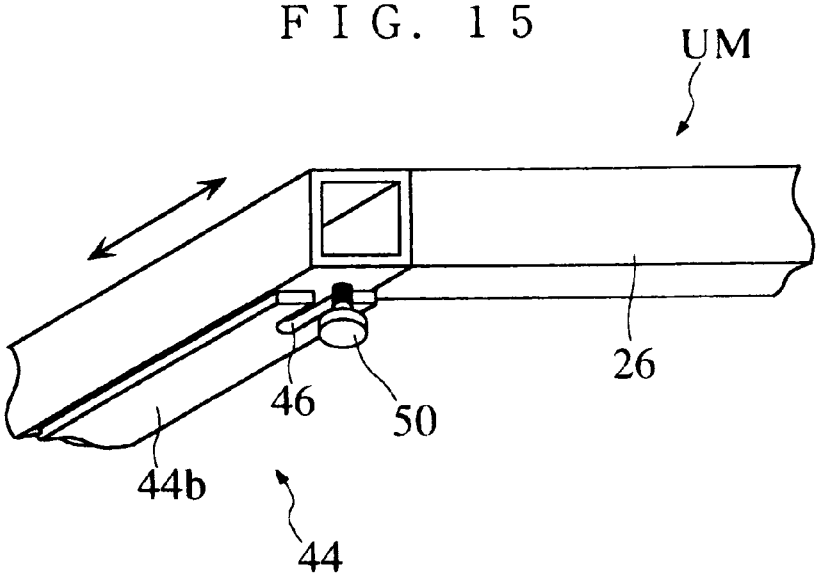
FIG. 15 is a perspective view showing a manner of positioning the key bed with respect to the key bed stay and fixing the former to the latter.
Figure 16:
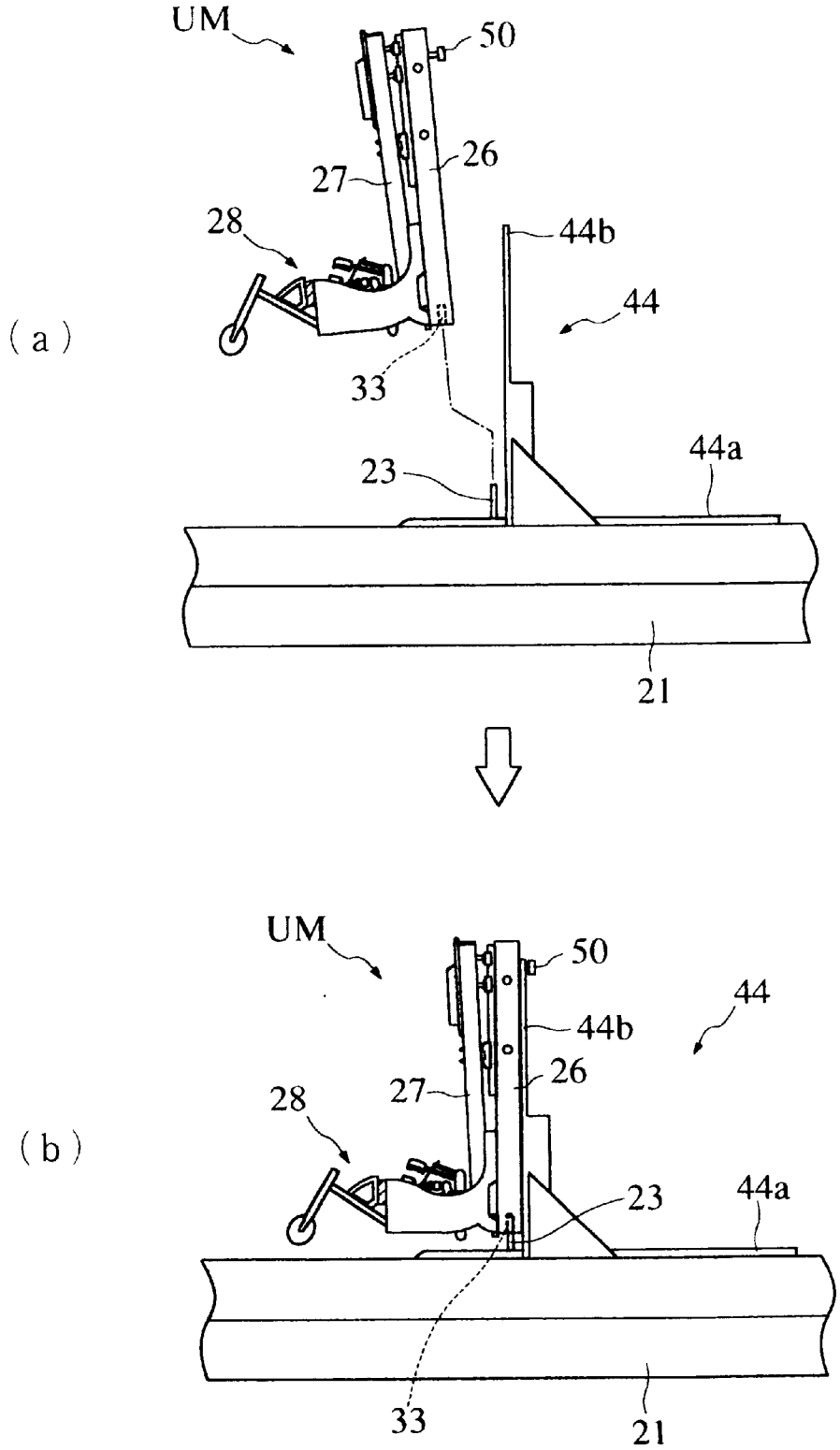
FIG. 16 consists of views illustrating a manner of mounting the mechanical unit on the plate.

Next, the mechanical unit UM is joined. The joining of the mechanical unit UM is carried out by the use of the key bed stays 44, as shown in FIGS. 14 to 16. The key bed stays 44 are provided in pair at respective right and left locations, and made of metal, such as iron. As best illustrated in FIG. 14, each key bed stay 44 is comprised of a plate-attaching part 44*a* which is U-shaped in cross-section and extends vertically, and a key bed-supporting part 44*b* which extends toward the front from the upper end of the plate-attaching part 44*a*, the plate-attaching part 44*a* and the key bed-supporting part 44*b* forming an L shape. The plate-attaching part 44*a* is formed with a pair of plate-positioning dowel pins 45, 45 projecting from respective predetermined upper and lower portions of a rear side surface thereof. Further, the key bed-supporting part 44*b* has a length in a transverse direction sufficient for supporting the key bed 26, and is also formed with a guide slot 46 which opens in a front end thereof.

The key bed stay 44 is attached to the plate 21 of the frame unit UF, in a manner as illustrated in FIG. 14. More specifically, bushings 47 made of resin are fit into the key bed stay-positioning dowel holes 24 formed in the plate 21, and the plate-positioning dowel pins 45 of the key bed stay 44 are respectively inserted into the bushings 47 with washers 48 made of resin interposed therebetween as spacers. Then, the key bed stay 44 is secured to the plate 21 by means of three screws 49 which are driven in from the key bed stay side. The engagement of the plate-positioning dowel pins 45 with the key bed stay-positioning dowel holes 24 enables the key bed stay 44 to be accurately positioned to predetermined locations in longitudinal and vertical directions with respect to the plate 21.

Next, the mechanical unit UM is joined to the plate 21 via the key bed stay 44 thus attached to the plate 21, in a manner illustrated in FIGS. 15 and 16. First, tapping screws (screws) 50 are loosely fitted to a bottom of the key bed 26 of the mechanical unit UM at respective front locations, and then the key bed 26 is placed on the key bed stays 44. The plate-positioning dowel holes 33 formed in the key bed 26 are fitted on the key bed-positioning dowel pins 23 of the plate 21, with the tapping screws 50 of the key bed 26 being engaged with the guide slots 46 of the key bed stays 44, respectively. After the key bed 26 is slid along the guide slots 46 and adjusted to a predetermined location, the tapping screws 50 are fastened to fix the key bed 26 to the key bed stays 44, thereby terminating the present process step.

Thus, the key bed 26 is placed on the key bed stays 44 accurately positioned and fixed to the plate 21, and the tapping screws 50 are slidably guided in a transverse direction while being restricted in lateral movement by the guide slots, whereby the key bed 26 is adjustably positioned to the predetermined location in three directions, i.e. in vertical, longitudinal, and transverse directions with respect to the plate 21. In the present embodiment, the key bed 26 is attached to the plate 21 without any casing component parts interposed therebetween, so that the assembly of the upright piano is free from adverse affects of manufacturing errors of the casing component parts and deformations of the same after manufacturing. Undesired vertical movements of the key bed 26 are also reliably inhibited by fixing the front portions of the key bed 26 to the key bed stays 44 by means of the tapping screws 50.

Further, the engagement of the plate-positioning dowel holes 33 with the key bed-positioning dowel pins 23 of the plate 21 ensures even more accurate positioning of the key bed 26 in vertical and longitudinal directions, as well as positively prevents the inner part of the key bed 26 from being bent down.

Therefore, the above joining method enables the key bed 26 of the mechanical unit UM to be mounted on the plate 21 in a state in which the key bed 26 is accurately positioned with respect to the plate 21 to a predetermined location in the three directions (longitudinally, vertically, and transversely). Further, as described under the headline of Mechanical unit-assembling step, the mechanical unit UM itself is accurately adjusted beforehand such that with reference to the key bed 26, the keys 27, the action assemblies 28, the hammer assemblies 29 and the damper assemblies 30 are correctly positioned with respect to each other. Therefore, after the mechanical unit UM is joined, the keys 27, the action assemblies 28, and the strings W stretched over the plate 21 are hardly out of alignment, which greatly facilitates adjusting operations, such as string-striking action adjustment of the action assemblies, which is carried out after joining the mechanical unit UM to the assembly of the units UB, US, and UF.

Further, as is clear from the above description, all the steps from the sound board unit-joining step to the mechanical unit-joining step can be carried out with the back post unit being in a flat position, which assures very excellent working conditions.

13. Casing unit-assembling step

Next, the casing unit UC is joined. At this process step, as shown in FIG. 17, the back post unit UB, the frame unit UF, etc. joined to each other is set in an erected position, and each unit of the casing unit UC is joined to the plate 21 with tapping screws 51. In this case, the positioning of each casing unit UC is carried, for instance, in vertical and transverse directions, by engaging dowel pins 36*a* formed on the inside surface of the arm 36 of each casing unit UC with dowel holes 26*b* formed in a corresponding one of the outside end faces of the key bed 26, and in a longitudinal direction by using plate longitudinal adjustment plates 52, 52 attached to opposite outside end faces of the plate 21, as shown in FIG. 18.

Figure 18:
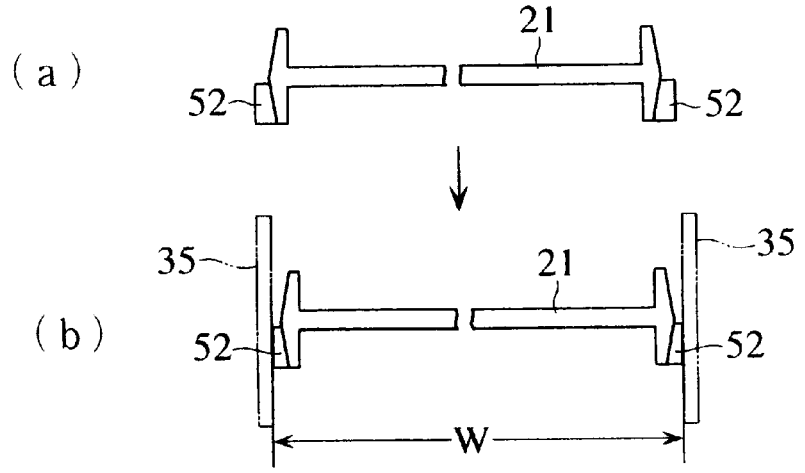
FIG. 18 consists of plan views illustrating a manner of positioning component parts of the casing unit.

More specifically, first, the plate longitudinal adjustment plates 52, 52 made of wood are attached to the outside end faces of the plate 21 (see FIG. 18(*a*)). Then, a handy molding machine, not shown, is slid along positioning jigs, not shown, attached to the plate 21 using dowel holes, not shown, formed in the plate 21 to thereby shave the plate longitudinal adjustment plates 52, whereby the outer dimensions between the longitudinal plate-adjusting plates 52, 52 can be easily adjusted to a predetermined inner dimension (width) W between the end panels 35 (see FIG. 18(*b*)). This makes it possible to accurately position the casing units UC to the assembly of the frame unit UF, in the three directions, i.e. in vertical, longitudinal, transverse directions.

14. Pedal unit-joining step

Next, the pedal unit UP is joined as a final unit to be joined. This process step completes joining of all the units.

15. Final step

Figure 2:
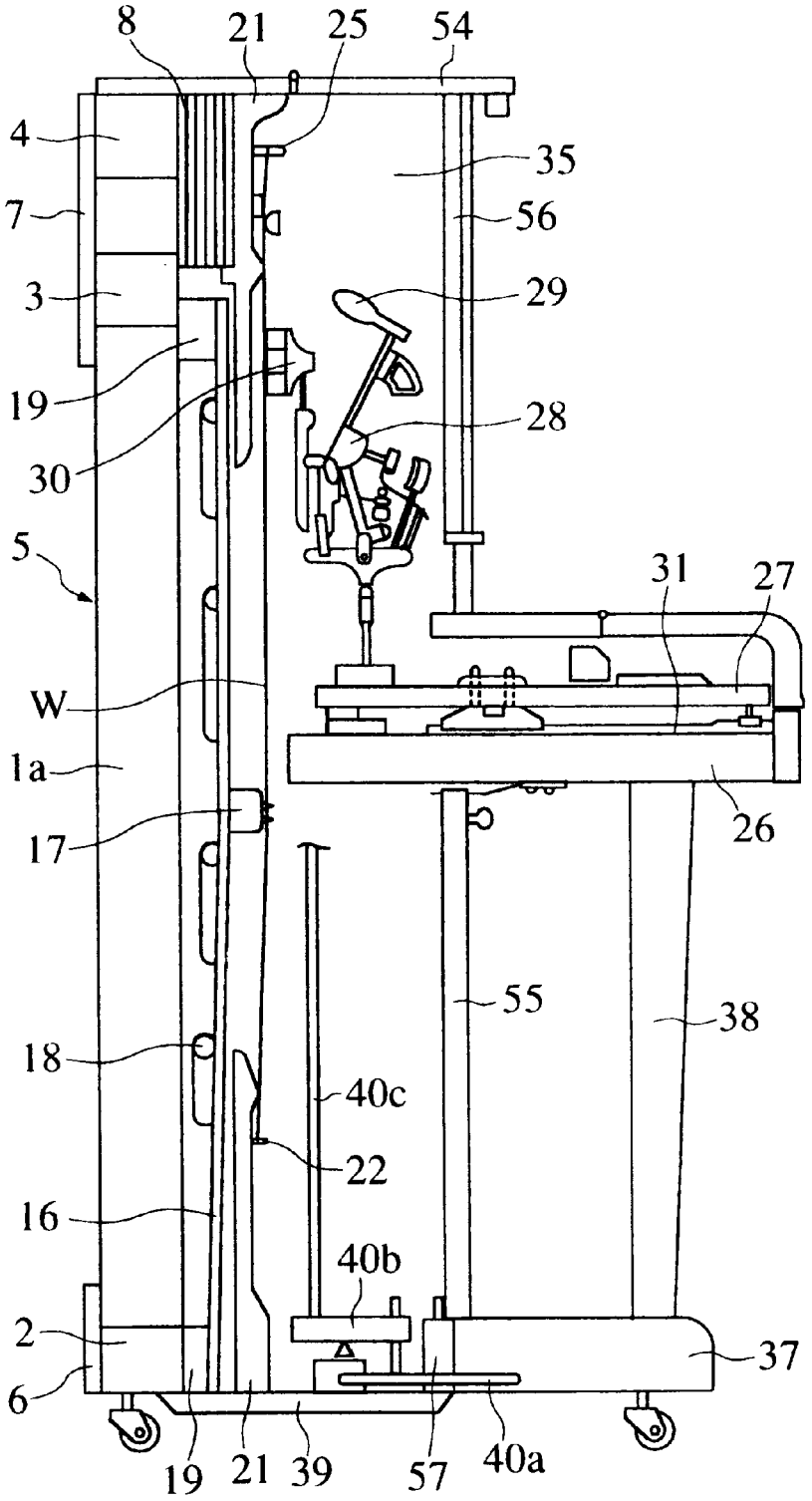
FIG. 2 is a sectional side elevation showing the upright piano assembled according to the FIG. 1 method.

Finally, remaining casing component parts 53, such as a top board 54, a lower panel 55, an upper panel 56, and a toe rail 57 are joined to the resulting assembly assembled as described above, and then final adjustments of the action assemblies 28, such as string-striking action adjustment, are carried out, to complete assembling of the upright piano shown in FIG. 2.

As described heretofore, according to the present embodiment, the upright piano is basically formed of the seven units UB, US, UF, UW, UM, UC, and UP. The units are each separately assembled, and then joined to each other to complete the upright piano. Therefore, it is possible to assemble the units at respective different sites in a decentralized manner, which enables the upright piano to be assembled in smaller space with smaller production facilities compared with the conventional methods of assembling the upright piano. As a result, it is possible to select sites for assembly more freely, and hence, a method of production can be readily adopted in which by taking into account e.g. conditions of procurement of materials and component parts, labor costs, level of technology, etc. most advantageous regions or countries are selected for production of respective units, and then, the units are assembled for completing pianos in a region near consuming areas or the market. This enables reduction of labor costs, transport costs, etc. Further, with improvement of mobility or flexibility in production, it is easy to adapt to small or medium-scale production or overseas production of pianos.

Further, the units are each properly adjusted in respect of alignment of component parts, etc., in advance, and then joined to each other. Therefore, after assembly, it is only required to effect slight and fine adjustments between the units, which facilitates the adjustment work. The mechanical unit UM, in particular, is accurately adjusted in advance with reference to the key bed 26 such that the keys 27, the action assemblies 28, the hammer assemblies 29, and the damper assemblies 29 are in alignment with each other, so that when the mechanical unit UM is joined to the frame unit UF thereafter, it is possible to very easily carry out the final adjustment work of the action assemblies 28, such as string-striking action adjustment, to which advantageous effects also contributes the direct and accurate attachment of the key bed 26 to the plate 21 via the key bed stays 44. That is, even if the action assemblies 28 and the strings W are slightly out of alignment after joining the units UM and UF to each other, the adjustment can be easily effected by merely moving the whole mechanical unit UM including the key bed 26 relative to the plate 21 of the frame unit UF for fine adjustments.

Next, a method of assembling an upright piano according to a second embodiment of the invention will be described with reference to FIGS. 19 to 22. As shown in FIG. 20, the upright piano is a no-back post type in which the back post assembly 5 according to the first embodiment is abolished, and the upright piano is assembled using a plate 21 as a basis. Further, strings W and tuning pins 25 are not formed into a string unit, but are attached separately.

Figure 19:
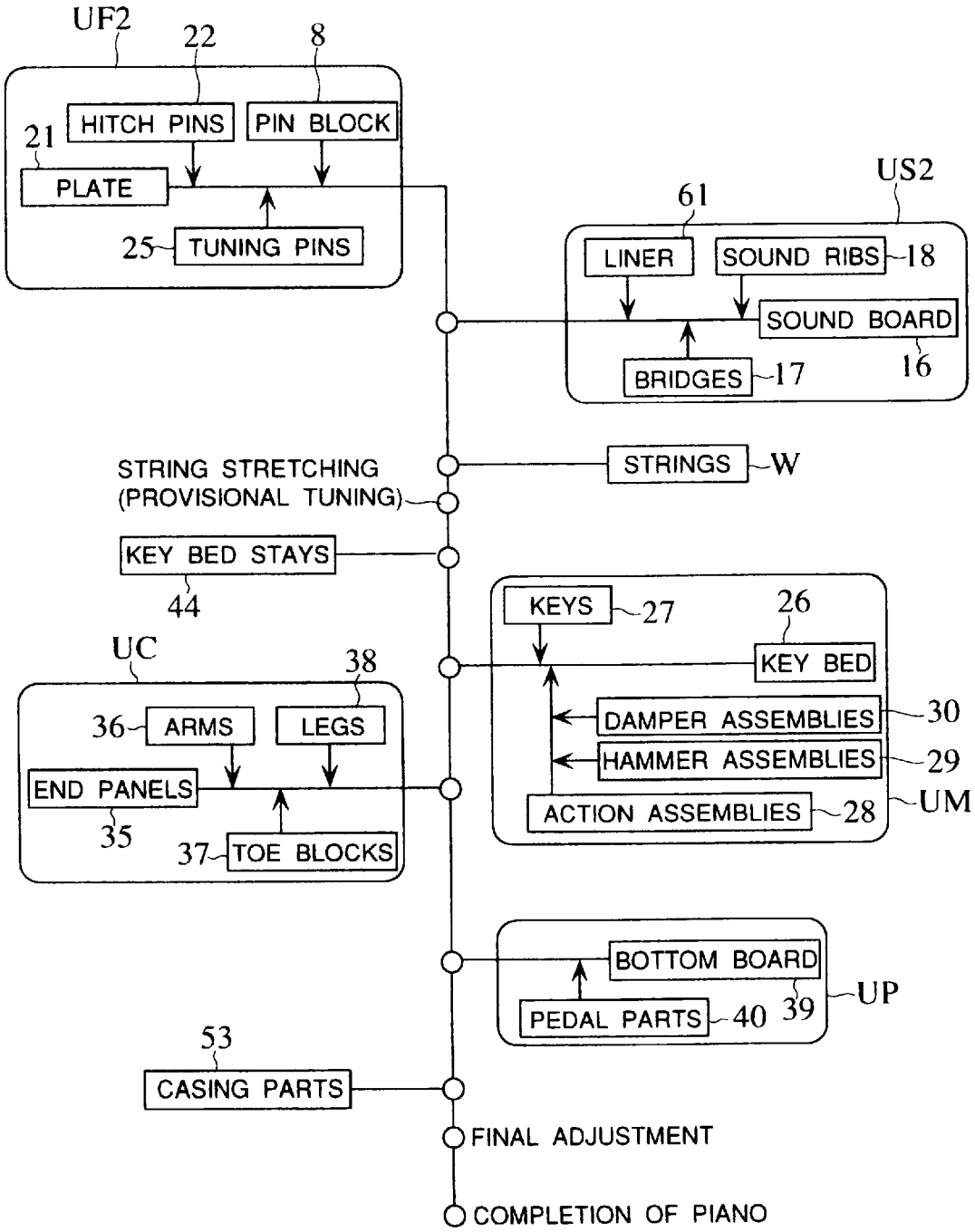
FIG. 19 is an operation chart illustrating a method of assembling an upright piano, according to a second embodiment of the invention.
Figure 20:
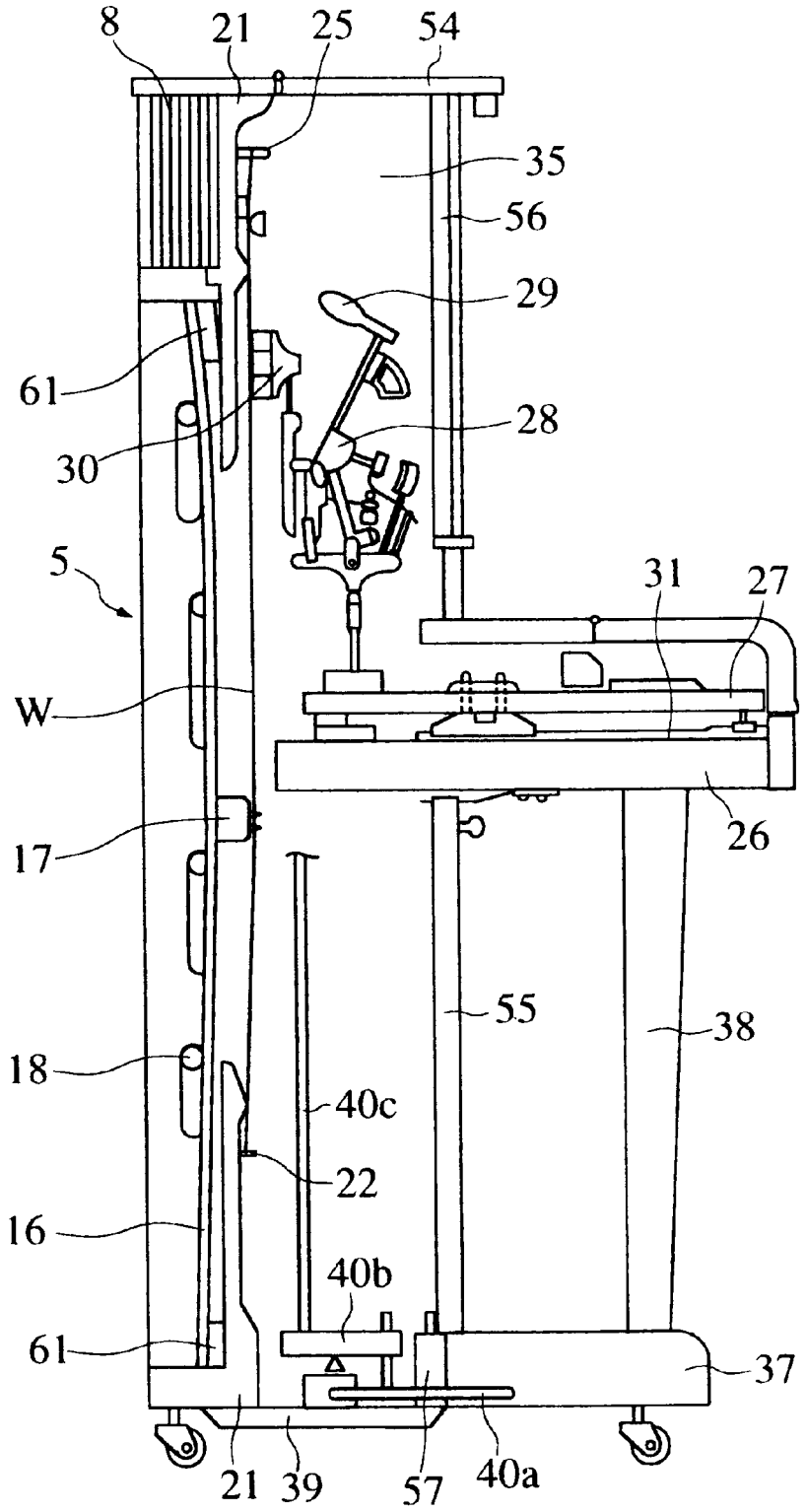
FIG. 20 is a sectional side elevation showing an upright piano assembled according to the FIG. 19 method.

As a result, according to the present assembling method, as shown in FIG. 19, the upright piano is basically divided into five separate units, that is, a frame unit UF2, a sound board unit US2, a mechanical unit UM, a casing unit UC, and a pedal unit UP, which are assembled into the upright piano. Further, substantial portions of the arrangement of each unit and manner of assembling the same as well as manners of joining of units are common to those of the first embodiment, and hence in the following description, common component elements and parts are designated by identical reference numerals, and description will be made mainly of differences from the first embodiment.

1. Frame unit-assembling step

Figure 21:
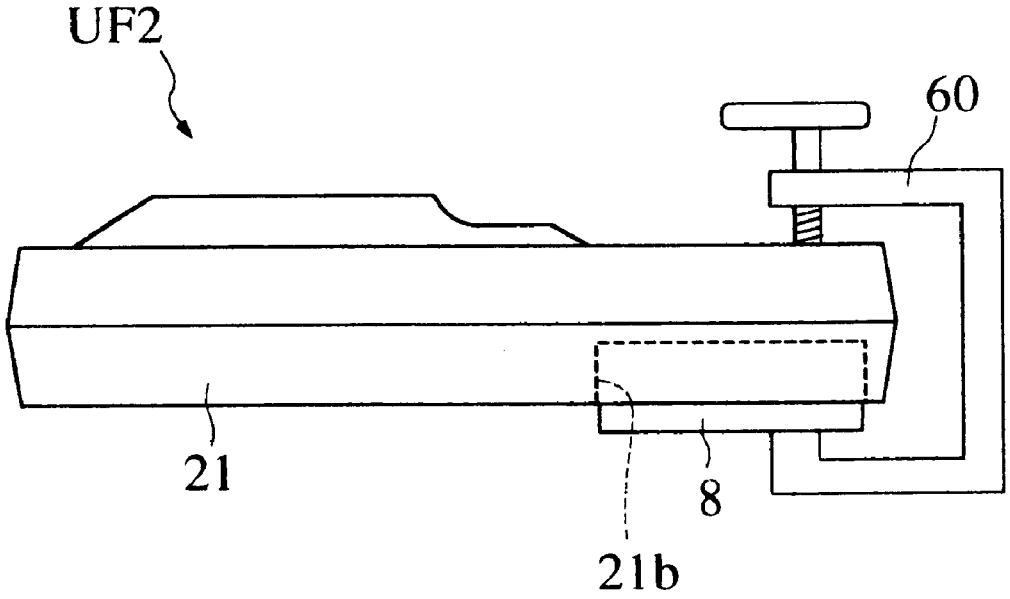
FIG. 21 is a view illustrating a manner of attaching a pin block to a plate.

The frame unit UF2 is comprised of, the plate 21 and hitch pins 22, which constitute the fame unit UF of the first embodiment, as well as a pin block 8 and tuning pins 25. The plate 21 has a rear surface thereof formed, when it is cast, with a pin block-receiving recess 21*b* at an upper location, which opens toward the rear side, and a sound board-receiving recess 21*c* which opens below the pin block-receiving recess 21*b* (see FIG. 20). In assembling the frame unit UF2, first, predetermined holes are formed in the plate 21. Then, as shown in FIG. 21, the pin block 8 is fit in the pin block-receiving recess 21*b* of the plate 21, and the pin block 8 is fixed to the plate 21 with screws while clamping these members by means of a clamp 60. Then, the tuning pins 25 are driven into the pin block 8, and the hitch pins 22 are embedded in the plate 21 to terminate the present process step.

2. Sound board unit-assembling step

The sound board unit US2 is comprised of a sound board 16, bridges 17, sound ribs 18, and a liner 61, similarly to the sound board unit US of the first embodiment, and assembled in the same manner as the sound board unit US. However, the liner 61 is distinguished from the liner 19 of the first embodiment in that the liner 61 is flat with a fixed width without any inclined surface, and serves as a spacer in joining the sound board unit US2 to the plate 21, as will be described hereinafter.

3. Steps of assembling the mechanical unit, the casing unit, and the pedal unit.

The arrangement of each of the mechanical unit UM, the casing unit UC, and the pedal unit UP, and the manner of assembling thereof are quite the same as those of the first embodiment.

4. Frame unit/sound board unit-joining step

Figure 22:
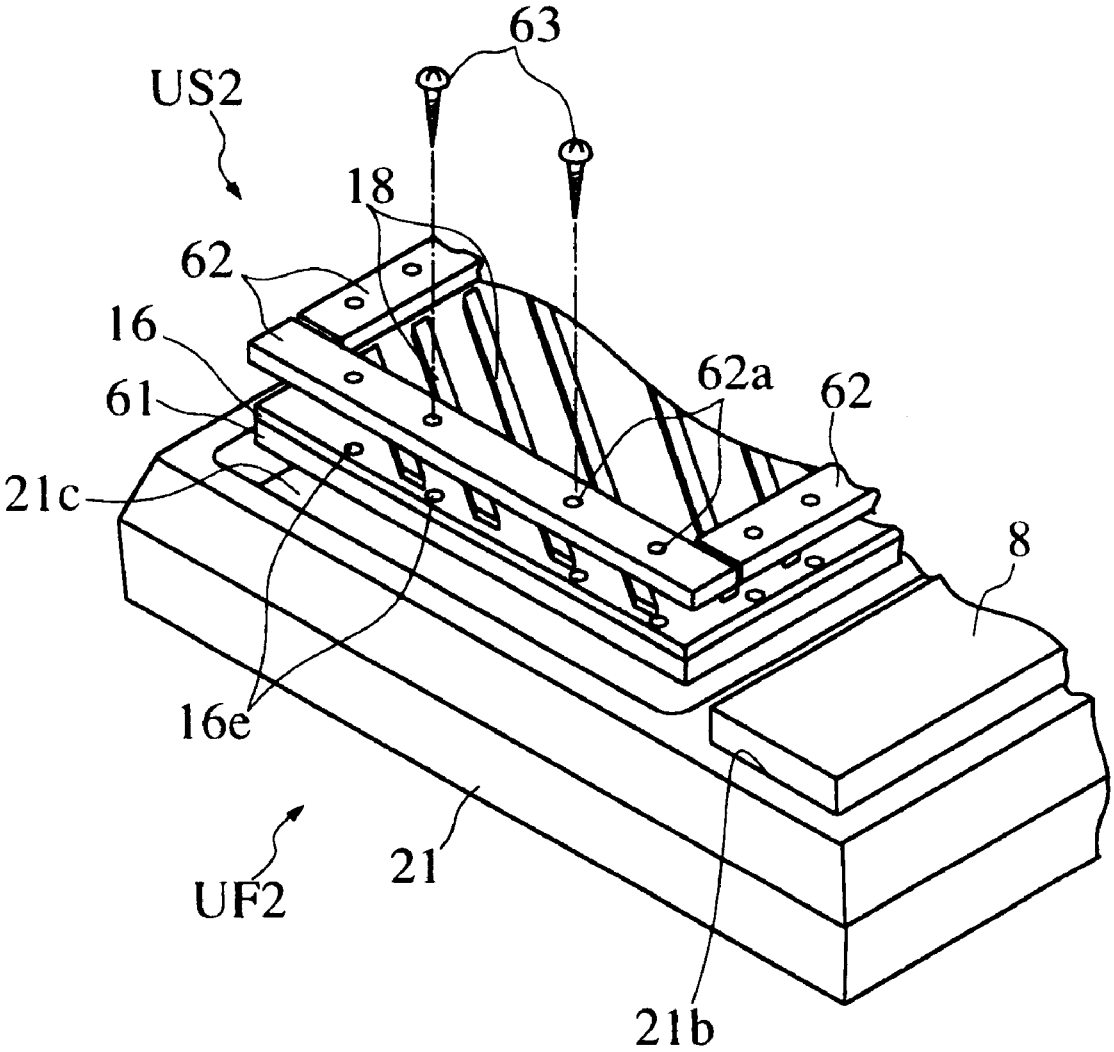
FIG. 22 is a perspective view illustrating a manner of joining a sound board to the plate.

At this step, first, as shown in FIG. 22, the frame unit UF2 is turned inside out, and the sound board unit US2 is fitted in the sound board-receiving recess 21*c* of the plate 21. Then, plate-positioning dowel holes and sound board-positioning dowel holes, neither of which is shown, formed in respective corresponding portions of the sound board 16 and the plate 21 are aligned to each other, and dowels are used to position the sound board 16 and the plate 21 with respect to each other. Then, four sound board retainers 62 each formed of matoa are arranged in the periphery of the sound board 16. The sound board retainers 62 are formed with screw holes 62*a* at locations corresponding to plate-attaching holes 16*e* of the sound board 16 in advance. Then, after these holes are aligned to each other, tapping screws 63 are fastened to secure the units UF2 and US2 to each other.

The bottom surface of the sound board-receiving recess 21, i.e. an abutment surface thereof which the liner 61 abuts has a predetermined curved configuration, whereby when the sound board unit US2 is joined, the soundboard 8 is imparted with a predetermined slightly crowned shape along the curved configuration of the abutment surface. Therefore, the liner 61 may be flat with a fixed thickness, and cutting of the liner, which is conventionally carried out but troublesome, can be dispensed with, thereby facilitating the imparting of the crowned shape to the sound board 61. Then, the whole of the joined units UF2 and US2 is turned over to stretch the strings W between the tuning pins 25 and the hitch pins 22 embedded on the plate 21, and provisional regulation is carried out, followed by terminating the present process step.

5. Mechanical/Casing/Pedal units-joining step and final step

These steps are carried out in the same manner as in the first embodiment, thereby completing the upright piano shown in FIG. 20.

As described above, in the present embodiment as well, the upright piano is divided into units, and after these units are each assembled separately, they are joined to each other to complete the upright piano. This provides the same advantageous effects of unitization of component parts as obtained by the first embodiment.

It should be noted that the invention is not limited to the embodiments described herein, but it can be embodied in various forms. For example, the number of different types of units may be determined as desired. Although in the second embodiment, for example, the strings W and the tuning pins 25 are separately assembled, this is not limitative, but they may be formed into the string unit UW, as in the first embodiment. Further, the arrangement of each unit maybe changed as desired. For example, although in the first embodiment, the pin block 8 is incorporated into the back post unit UB, this is not limitative, but it may be incorporated into the frame unit UF as in the second embodiment. Further, although the casing unit UC is comprised of the end panels 35, the arms 36, the toe block 37, and the legs 38, in the above embodiments, this is not limitative, but other casing component parts, such as the toe rail 57, may be additionally included, or inversely, the number of component parts incorporated therein may be reduced.

Further, although in the above embodiments, to properly position the key bed stays 44 with respect to the plate 21, the plate-positioning dowel pins 45 are provided on the key bed stay 44 and the key bed stay-positioning dowel holes 24 are formed in the plate 21, these positioning means may be provided inversely in gender, i.e. the dowel pins may be provided on the plate 21, and the dowel holes in the key bed stays 44, or they may be provided in a mixed manner in each of the plate 21 and the key bed stays 44. This also applies to the dowel pins and the dowel holes for positioning the key bed 26 with respect to the plate 21. Further, although the key bed stays 44 are provided in pair, one for the right side and the other for the left side, three or more key bed stays can be provided. It is further understood by those skilled in the art that the foregoing description is preferred embodiments of the invention and that various changes and modifications may be made in the invention without departing from the spirit and scope thereof.

Industrial Applicability

As described in detail heretofore, the method of assembling an upright piano according to the invention is suitable for assembling upright pianos with improved efficiency and high accuracy in smaller space and smaller-scale production facilities.

We claim:

1. Method of assembling an upright piano, comprising the steps of:

separately assembling each of a plurality of different units, and joining said different units to each other to thereby assemble said upright piano, wherein one of said plurality of different units is a back post unit comprising a back post assembly which is assembled by framing outer back posts a top beam, and a bottom beam, and wherein said back post assembly is assembled by placing said outer back posts, said bottom beam, and said top beam, within a frame having predetermined inside dimensions, and joining said outer back posts, said bottom beam, and said top beam to each other, while said outer back posts, said bottom beam, and said top beam are in a state in which said outer back posts, said bottom beam, and said top beam are pressed against inner surfaces of said frame.

2. Method of assembling an upright piano according to claim 1, wherein said back post unit includes a bottom beam cover and a top beam cover attached to a rear surface of said back post assembly in a fashion covering said bottom beam and said top beam, respectively.

3. Method of assembling an upright piano according to claim 1 or claim 2, wherein said back post unit includes a pin block attached to an upper portion of a front surface of said back post assembly, said pin block being positioned with reference to an upper end surface of said back post assembly.

4. Method of assembling an upright piano, comprising the steps of:

separately assembling each of a plurality of different units, and joining said different units to each other to thereby assemble said upright piano, wherein one of said plurality of different units is a back post unit comprising a back post assembly which is assembled by framing outer back posts, a top beam, and a bottom beam, wherein one of said plurality of different units is a sound board unit comprising a sound board, bridges attached to a front surface of said sound board, and sound ribs attached to a rear surface of said sound board, and wherein said sound board is secured to a front surface of said back post assembly to thereby join said sound board unit to said back post unit.

5. Method of assembling an upright piano, according to claim 4, wherein said sound board unit includes a liner attached to a periphery of said rear surface of said sound board, said liner having a surface thereof attached to said sound board, said surface of said liner being formed with a portion having a predetermined inclined surface, said sound board being secured to said back post assembly by way of said liner.

6. Method of assembling an upright piano according to claims 4 or 5, wherein when said sound board unit is joined to said back post unit, said sound board is positioned to a predetermined location with respect to said back post assembly by sound board-positioning means.

7. Method of assembling an upright piano according to claim 4, wherein one of said plurality of different units is a frame unit including a plate and hitch pins arranged thereon, and wherein said plate is fixed to a front surface of said back post assembly with said sound board interposed between said plate and said front surface of said back post assembly, to thereby join said frame unit to said back post unit.

8. Method of assembling an upright piano according to claim 7, wherein when said frame unit is joined to said back post unit, said plate is positioned to a predetermined location with respect to said back post assembly by plate-positioning means.

9. Method for assembling an upright piano according to claim 7, wherein when said frame unit is joined to said back post unit, space between a surface of said sound board and a surface of said plate opposed to each other is adjusted to a predetermined distance by means of a spacer interposed between said sound board and said plate.

10. Method of assembling an upright piano according to claim 7, wherein one of said plurality of different units is a string unit comprising a multiplicity of string assemblies, each of said string assemblies having a string and two tuning pins around which ends of said string are wound, respectively.

11. Method of assembling an upright piano according to claim 10, wherein said two tuning pins of each of said string assemblies are embedded in a pin block provided on said back post unit, and wherein said string is engaged with a corresponding one of said hitch pins of said frame unit, and then stretched.

12. Method of assembling an upright piano according to claim 7, wherein one of said plurality of different units is a mechanical unit comprising a key bed, and keys, action assemblies, hammer assemblies and damper assemblies mounted on said key bed, and wherein said mechanical unit is joined to said frame unit by securing said key bed to said plate.

13. Method of assembling an upright piano according to claim 12, wherein said key bed is secured to said plate by way of a plurality of key bed stays fixed to said plate, a rear surface of each of said plurality of key bed stays and a front surface of said plate having cooperating key bed stay-positioning dowel holes and key bed stay-positioning dowel pins provided at respective predetermined locations, each of said plurality of key bed stays being secured to said plate, in a state in which said dowel pins and said dowel holes are engaged with each other.

14. Method of assembling an upright piano according to claim 13, wherein said key bed is slid on said key bed stays in a transverse direction by guiding said key bed by key bed guide means to thereby fix said key bed to said key bed stays at a predetermined location in said transverse direction.

15. Method of assembling an upright piano according to claim 14, wherein said key bed guide means is formed by a guide slot formed in a front end portion of said each of said plurality of said key bed stays in a fashion extending in said transverse direction, and wherein said key bed has screws each attached to a bottom of a front portion of said key bed for engagement with said guide slot.

16. Method of assembling an upright piano according to claim 15, wherein said guide slot opens at a front end surface of said key bed stay.

17. Method of assembling an upright piano according to any one of claims 13 to 16, wherein said plate and said key bed have cooperating key bed-positioning dowel holes and key bed-positioning dowel pins provided at respective predetermined locations of a front surface of said plate and a rear end surface of said key bed.

18. Method of assembling an upright piano according to any of claims 12 to 16, wherein said mechanical unit is regulated in advance before said mechanical unit is joined to said frame unit.

19. Method of assembling an upright piano according to any of claims 12 to 16, wherein said key bed is formed by framing a plurality of hollow metal profiles.

20. Method of assembling an upright piano according to claim 12, wherein one of said plurality of different units is a casing unit which is assembled by joining at least end panels, arms, and toe blocks to each other.

21. Method of assembling an upright piano according to claim 20, wherein one of said plurality of different units is a pedal unit which is assembled by joining at least a bottom board and pedal component parts to each other.

22. Method of assembling an upright piano, comprising the steps of:

separately assembling each of a plurality of different units, and joining said different units to each other to thereby assemble said upright piano, wherein one of said plurality of different units is a back post unit comprising a back post assembly which is assembled by framing outer back posts, a top beam, and a bottom beam, wherein said back post assembly is assembled by placing said outer back posts, said bottom beam, and said top beam, within a frame having predetermined inside dimensions, and joining said outer back posts, said bottom beam, and said top beam to each other, while said outer back posts, said bottom beam, and said top beam are in a state in which said outer back posts, said bottom beam, and said top beam are pressed against inner surfaces of said frame, and wherein said back post unit includes a pin block attached to an upper portion of a front surface of said back post assembly, said pin block being positioned with reference to an upper end surface of said back post assembly.

* * * * *